US006813851B2

(12) United States Patent
Mieger et al.

(10) Patent No.: US 6,813,851 B2
(45) Date of Patent: Nov. 9, 2004

(54) QUICK COUPLING

(75) Inventors: Rolf Mieger, Kirchdorf-Unteropfingen (DE); Thomas Zitterbart, Dietenheim (DE)

(73) Assignee: Liebherr-Hydraulikbagger GmbH, Kirchdorf/Iller (DE)

( * ) Notice: Subject to any disclaimer, the term of this patent is extended or adjusted under 35 U.S.C. 154(b) by 73 days.

(21) Appl. No.: 10/095,186

(22) Filed: Mar. 11, 2002

(65) Prior Publication Data

US 2002/0157287 A1 Oct. 31, 2002

(30) Foreign Application Priority Data

Mar. 9, 2001 (DE) ..... 101 11 485
Dec. 4, 2001 (DE) ..... 101 59 417

(51) Int. Cl.[7] ..... E02F 3/96
(52) U.S. Cl. ..... 37/468; 37/417
(58) Field of Search ..... 37/468, 403, 417, 37/702; 414/723, 686, 644, 918

(56) References Cited

U.S. PATENT DOCUMENTS

| | | | | |
|---|---|---|---|---|
| 5,108,252 A | | 4/1992 | Gilmore, Jr. et al. | |
| 5,829,337 A | | 11/1998 | Barden | |
| 6,196,265 B1 | * | 3/2001 | Horton et al. | 137/614 |
| 6,428,265 B1 | * | 8/2002 | Gilmore, Jr. | 414/723 |

FOREIGN PATENT DOCUMENTS

| | | |
|---|---|---|
| DE | 8125814.3 | 10/1981 |
| DE | 29810118 | 10/1998 |
| DE | 19751292 | 2/1999 |
| DE | 19881458 | 11/1999 |
| WO | 91/01414 | 2/1991 |

* cited by examiner

*Primary Examiner*—Thomas B. Will
*Assistant Examiner*—Meredith Petravick
(74) *Attorney, Agent, or Firm*—Dilworth & Barrese LLP

(57) ABSTRACT

A quick coupling for coupling a tool to the boom of a hydraulic excavator and the like with a quick coupling part at the boom side and a quick coupling part at the tool side which can be latched together via a pair of spaced latching axles and with a power circuit coupling, in particular a hydraulic coupling, for the automatic coupling of a power connector at the tool side to a power connector at the boom side, wherein the power circuit coupling has a power coupling part at the boom side and a power coupling part at the tool side which ar arranged at the quick coupling part at the boom side or at the quick coupling part at the tool side such that they automatically couple as soon as the two quick coupling parts are pivoted together into their latching position about a first of the two latching axles. The quick coupling is characterized by a linear guide being associated with the power circuit coupling which guides the two power coupling parts in a linear manner with respect to one another during coupling despite the pivot movement.

36 Claims, 17 Drawing Sheets

QUICK COUPLING

BACKGROUND OF THE INVENTION

The invention relates to a quick coupling for coupling a tool to the boom of a hydraulic excavator and the like having a quick coupling part at the boom side and a quick coupling part at the tool side, which can be latched to one another via a pair of spaced latching axles, and a power circuit coupling, in particular a hydraulic coupling, for coupling a power connection at the tool side to a power connection at the boom side, wherein the power circuit coupling has a power coupling part at the boom side and a power coupling part at the tool side, which are arranged at the quick coupling part at the boom side or at the quick coupling part at the tool side such that they automatically couple with one another as soon as the two quick coupling parts are pivoted together about a first of the two latching axles into their latching position.

Quick couplings of the pivot type are widespread in hydraulic excavators since they allow a simple and fast changing of different tools such as hydraulic grabs, ditch cleaning shovels, grab tongs and the like. Initially, only one of the two latching axles need to be positioned and brought into engagement for coupling. This can advantageously be a transverse bolt which is hung into a hook-like eyelet on the opposite coupling part. Then the coupling part at the boom side can be pivoted relative to the tool about the latching axle already brought into engagement to hereby find the latching position in which the second latching axle can be latched. The latter is as a rule formed by a pair of latching bolts which can move apart and into corresponding latching bores at the opposite quick coupling part.

Such a fast coupling of the pivot type is known from WO 91/01414 in which an automatic hydraulic coupling is provided which automatically couples a power circuit at the boom side to a power circuit at the tool side when the two quick coupling parts are pivoted together. There are two power coupling parts provided of which one is secured to the quick coupling part at the boom side and the other to the quick coupling part at the tool side, and indeed such that the two power coupling parts are moved towards one another and brought into engagement when the two quick coupling parts are pivoted together about the already latched latching axle. One of the two power coupling parts is movably mounted at the corresponding quick coupling part to compensate the circular movement of the quick coupling parts during the pivoting together.

This known quick coupling is, however, not sufficient in a number of aspects. The power coupling parts do not couple cleanly when the quick coupling parts are moved together so that oil leaking and thus a contamination of the soil can occur. Due to tilting of the power coupling parts, these are subject to great wear and can even be damaged.

SUMMARY OF THE INVENTION

It is therefore the underlying object of the present invention to provide an improved quick coupling of the kind first mentioned which avoids the disadvantages of the prior art and advantageously further develops the latter. In particular, an improved arrangement of the power coupling should be provided which allows a leak-free and defect-free coupling of the power circuits at the boom side and at the tool side.

In accordance with the invention, this object is solved by a quick coupling as described herein. Preferred embodiments of the invention are also described herein.

In accordance with the invention, the power coupling parts are moved towards one another in an exactly linear manner. A linear guide is provided for the power coupling parts which forces the power coupling parts into a relative movement with respect to one another along a straight line against the circular pivot movement. To allow the compensation of the pivot movement, at least one of the two power coupling parts is mounted at the corresponding quick coupling part movably relative thereto. It is, however, provided in a further development of the prior art that the movably mounted power coupling part compensates the pivot movement during the moving together of the quick coupling parts and moves precisely such that an exact linear movement takes place between the two power coupling parts.

In a further development of the invention, the linear guide has at least one guide element at the boom side and at least one guide element at the tool side which enter into engagement with one another on the closing of the power circuit coupling before the two power circuit coupling parts, in particular their connection connectors, enter into engagement with one another. The linear guide therefore enters into and out of engagement on the pivot movement of the two quick coupling parts about the already latched first latching axle such as the power coupling parts. The engagement of the guide elements of the linear guide takes place, however, before the engagement of the connection connectors of the power coupling parts such that the linear guide of the power coupling parts is ensured from the start. No tilting can take place and a precise linear movement is ensured over the whole coupling path of the power coupling parts. The guide elements of the linear guide are therefore in particular components formed separately from the actual power coupling elements, i.e. the connector members. They are, however, preferably fixedly arranged at the power coupling parts or can be moulded to these.

The linear guide can generally be made in different manners. Optionally, a cam track can be provided for the movably mounted power coupling part or for the movably mounted power coupling parts. A cam-like control of the movement of the movable power coupling part(s) can also be provided. In a further development of the invention, however, there are preferably provided as guide elements at least one guide bolt at one of the power coupling parts and at least one guide bore at the other power coupling part. The guide bolt is pushed into an exact fit into the complementary guide bore when the power coupling parts are moved together, whereby a linear movement is ensured. Preferably, a pair of guide bolts spaced from one another and associated guide bores are provided, with the connection connectors being able to be arranged between the guide bolts or guide bores respectively. The guide bolts extend with their longitudinal axes parallel to the direction in which the connector connections can be pushed onto one another. As connection connectors, the power coupling parts can have female and male connector members known per se which can be pushed into one another.

The guide bolt(s) of the linear guide preferably have a special shape which prevents a tilting during insertion into the complementary guide bore. In particular, each of the guide bolts can have a rounded head, a cylindrical guide section and a constriction which is provided between the head and the cylindrical guide section. In the region of the constriction, the guide bolt has a diameter reduced with respect to the head or with respect to the guide section. The rounded head can also be inserted into the guide bore with a slight angular offset. An alignment or a compensation of the angular offset takes place when the cylindrical guide surface axially spaced from the bolt head likewise comes into engagement with the guide bore.

At least one of the two power coupling parts is movably mounted relative to the associated quick coupling part. Preferably only one is movably mounted while the other is rigidly secured to the other quick coupling part. In this way, a simple arrangement is achieved which nevertheless allows the required compensation of the pivot movement.

The movability of the mounting of the corresponding power coupling part is preferably formed in a multi-axial manner. In particular the mounting of the power coupling part can allow at least one tilting movement about an axis parallel to the first latching axle and a movement in a direction perpendicular to the first latching axle. It preferably also permits a pushing movement parallel to the first latching axle and/or a tilting movement about a tilting axis perpendicular to the first latching axle. With such a comprehensive movable mounting, lateral offset, for example as a result of imprecisions in the assembly, can also be compensated. In addition, the arrangement of the power coupling parts can also be produced more favourably due to coarser tolerances.

In a further development of the invention, one of the two power coupling parts is mounted on a spring device, in particular on a pair of compression springs. The compression springs can be rigidly secured to the corresponding quick coupling part and jointly bear the corresponding power coupling part. The compensation of the pivot movement with respect to the corresponding quick coupling part takes place by deformation of the spring device.

To achieve a secure moving together of the power coupling parts, a limitation of the spring path in the direction of the coupling movement can be provided. In a further development of the invention, a pressure ram can be provided on which the movable power coupling part sits in tiltable and/or displaceable manner.

The pressure ram preferably has a rounded head which can engage approximately centrally between the spring elements of the spring device at the power coupling part. The pressure ram presses the two power coupling parts reliably and securely onto one another in the final stadium of the coupling movement. The pressure ram can advantageously be of changeable length. The pressure ram can in particular be made resiliently to avoid damage and to allow a compensation of tolerances, with the spring constant of the pressure ram being able to be substantially harder than that of the resilient mounting of the power coupling part. In a further development of the invention, the pressure ram can be made as a hydraulic ram, i.e. it can be moved out or biased into its moved out position by a pressure medium. In this way, greater pressure can be applied to the movably mounted power coupling part, preferably towards the end of the coupling movement or after the fully moving together of the power coupling parts, so that the power coupling parts can be reliably held in their moved together position.

The hydraulic pressure with which the pressure ram holds the two power coupling parts together is adapted to the respective operating conditions in a particularly advantageous manner. The force holding together the power coupling parts is always selected to be so high that the parts are completely held together without play at any time. On the other hand, movement is not constantly with a maximum force which would be sufficient to hold the parts together under all operating conditions. The latter is disadvantageous with a solution by means of a spring. If the pressure ram should hold the power coupling parts together solely by spring force, the spring must be dimensioned so large that it holds the power coupling parts together under all conditions so that forces would act over wide paths which would be much too large. The pressure force can advantageously be varied with a hydraulic ram.

The pressure ram can in particular be fed with a pressure medium from one of the pressure medium circuits to be fed, i.e. the pressure ram is subjected to the action of the pressure fluid which is forwarded to the tool coupled via the power coupling. In this way, the holding together force also increases in dependence on the respective operating pressure of the tool. In an advantageous further development of the invention, the areal ratio between the effective working cylinder area of the pressure ram which is acted on by the pressure medium and the effective connector area, i.e. the effective flow cross-section through the coupling which is exposed to pressure medium perpendicular to the coupling direction in the region of the connectors, is selected to be larger than 1. An advantageous design can consist of the areal ratio amounting to approximately 5/4. The holding together force applied by the pressure ram is always higher due to this areal ratio than the maximum occurring force which attempts to press the power coupling apart. If the operating pressure in the pressure medium lines to be coupled increases, the force acting on the pressure ram and thus the holding together force also increases. Usually a plurality of pressure medium connectors are provided. Likewise, a plurality of pressure rams can be provided. In this case, the ratio of the sum of the effective working cylinder areas and the sum of the connector areas is selected in the previously described manner. In a further development of the invention, the cylinder of the pressure ram or the cylinders of the pressure rams can be put into flow connection with a plurality, in particular all, of the pressure medium lines of the pressure medium circuit to be coupled. A valve arrangement is preferably interposed between the pressure medium lines and the cylinder(s) which ensures that always that one of the pressure medium lines which has the highest pressure is in connection with the pressure ram. It is achieved in this way that the pressure ram is always acted on with the sufficiently large pressure. As the valve arrangement, the pressure medium lines can be switched together in pairs via shuttle valves so that, so to say, always the higher pressure is asserted.

The pressure ram can be fed from different sections of the pressure medium circuit. It is possible to connect the pressure medium circuit at the boom side to the pressure ram. The fluid connectors are usually provided with leak securing means so that the pressure ram can also already be actuated when the connectors are not yet connected, with the connectors being connected by the moving out of the ram. In a preferred aspect of the invention, however, the cylinder(s) are fed from the pressure medium circuit at the tool side, i.e. they are only acted on by pressure when the power circuit coupling, and in particular its fluid connectors, are moved together and the connectors have coupled.

In a further development of the invention, it can also be provided to move the power circuit coupling parts together with a time delay with respect to the pivoting together movement of the quick coupling. This can be simply achieved in that the hydraulic acting on the pressure ram is effected with a time lag.

A separate hydraulic circuit can be provided to actuate the pressure ram.

The movably mounted power coupling part and thus the pressure ram can generally be arranged at the boom side. In a further development of the invention, however, they are provided at the tool side.

It must be ensured between the pressure ram and the power coupling part acted upon by it that relative movements can take place, and indeed both tilt movements and displacement movements perpendicular to the longitudinal axis of the pressure ram. On the one hand, the movably mounted power coupling half compensates the pivot movement of the quick coupling halves to the extent that a linear movement is made out of the circular movement. Furthermore, relative movements occur as a consequence of play and the like. To permit this offset, the pressure ram and the power coupling half acted upon by it are movable relative to one another. To nevertheless enable large forces to be transmitted, it can be provided that the pressure ram is provided at the end face with a pressure cap which has a planar end surface such that it can sit tightly and areally on the essentially planar power coupling part. To permit tilting movements, it is preferably provided that the pressure cap and the pressure ram have areas arched in complement to one another with which they sit on top of one another such that the pressure cap can tilt on the ram itself and nevertheless an areal connection is provided.

To securely hold together the two power coupling parts even in rough operation, a form-locking latching of the two power coupling parts can be provided alternatively or additionally to the hydraulic pressure ram. In a further development of the invention, it can be provided that the guide bolt of the linear guide is locked when this is moved into the complementary guide bore. In particular a movable transverse bolt can be provided which is mounted in the power coupling part which has the said guide bore. The latching transverse bolt can preferably be acted on hydraulically. The transverse bolt can advantageously interact with the constriction of the guide bolt, i.e. when the guide bolt is fully moved into the guide bore, the latching transverse bolt is moved in tangentially to the guide bore such that it projects into the guide bore, and indeed in the region in which the constriction of the guide bolt is located.

In a further advantageous embodiment of the invention, a separate bar can be provided for the form-locking latching of the two power coupling parts in their coupled position. A bar flap is preferably provided. A setting cylinder which is preferably hydraulically operable can be provided for actuating the bar. The bar can be acted on by a spring such that it is biased in its latching position. In this way, the actuating means only needs to be actuated for unlatching.

In a further development of the invention, a pre-centring means is provided in addition to the linear guide for the two power coupling parts on the pivoting together of the quick coupling parts. The pre-centring means aligns the two power coupling parts towards one another by so much before the engaging of the linear guide that the corresponding guide elements of the linear guide can engage into one another in accordance with their purpose. This in particular has advantages if, in non-attentive operation, the first latching axle is not accurately adjusted or fully moved in on the pivoting together of the two quick coupling parts. In this case, alignment errors of the power coupling parts can occur which could effect damage to the power circuit coupling on the moving together. The pre-centration likewise corrects excessive alignment errors of the power coupling parts relative to the corresponding quick coupling part which can occur, for example, due to the movable mounting of at least one of the power coupling parts.

The pre-centring means can be made in different manners. It preferably has a pair of centring surfaces which slide off one another on the pivoting together of the quick coupling parts and of which one is provided at the movably mounted power coupling part. The other of the interacting centring surfaces can be provided at the other power coupling part. In a farther development of the invention, it can be arranged at the opposite quick coupling part. They are in particular arranged such that they enter into engagement in front of the linear guide.

In a further development of the invention, in addition to the pre-centring means, a pivot guide can be provided which ensures that the two quick coupling parts can only be pivoted together in their desired alignment to one another, i.e. when the first latching axle is properly aligned. The pivot guide prevents damage to the hydraulic coupling by moving together the quick coupling parts with an offset. In the latter case, the connection members, or the guide bolts, of the power coupling parts would likewise move towards one another with an offset and cause damage. The pivot guide has guide surfaces preferably provided at the solid pivot coupling parts themselves, which guide surfaces slide past one another or also slide off on one another on a proper alignment of the quick coupling parts on pivoting together about the first latching axle. They can be made in centring manner such that on pivoting together, the two quick coupling parts press into their desired alignment to one another in which the first latching axle is properly aligned. The guide surfaces advantageously prevent an offset of the two quick coupling halves with respect to one another before the second latching axle is latched, in particular when the power coupling parts have already come into engagement with one another. Such an offset would necessarily have the consequence of damage to the power coupling. The guide surfaces can in particular be made such that they interact with the first latching axle, which is formed in hook-like fashion, as soon as they are pushed over one another, so that an offset or a slipping of the quick coupling halves with respect to one another is prevented.

In accordance with a particularly advantageous embodiment of the invention, the power circuit coupling is a mounting unit which can be subsequently mounted to the two quick coupling parts. It is not an integral component of the quick changer. The power circuit coupling is preferably made such that even already existing quick changers can be retrofitted.

To ensure good accessibility to the power circuit coupling, in a further development of the invention, the power circuit coupling can be arranged outside the latching axles of the two quick coupling parts. The power circuit coupling in this case does not lie with difficult accessibility between the two latching axles, but can, for example, be easily reached for cleaning. In addition, in this connection, it is not disposed in the intermediate space between the two latching axles which is prone to the collection of contamination and dirt.

In a further development of the invention, the power circuit coupling is arranged within abutting areas of the quick coupling part at the tool side and/or of the quick coupling part at the boom side, in particular such that in the state of the two coupling parts separated from one another, the power circuit coupling parts do not abut the ground when the corresponding quick coupling part is placed on the ground. The two quick coupling parts can preferably each have two spaced carrier members substantially perpendicular to the latching axles and the power coupling parts can each be arranged transversely thereto between two carrier members which belong together. They are disposed in the protected region between the perpendicular carrier members of the quick coupling parts. The carrier members of the quick coupling parts are pushed into one another or over one another in the region of the latching axles. Unlike the prior art, the quick coupling part on the boom side can be free of a base plate which extends parallel to the latching axles and on which the power coupling part would be arranged. It is hereby avoided that when the coupling part at the boom side is placed on the ground with its base plate, the power coupling part arranged thereon is not pressed into the ground.

In a further development of the invention, the two power coupling parts are each made in essentially plate-like form. The already mentioned male or female connector members, which form the power connectors, are arranged on the plate-like carrier of the power coupling parts. The guide bolts or guide bores can be rigidly secured or worked in at a spacing therefrom.

BRIEF DESCRIPTION OF THE DRAWINGS

The invention will be described in the following with reference to preferred embodiments and to associated drawings. There are shown in the drawings.

DESCRIPTION OF THE PREFERRED EMBODIMENTS

Figure 1:
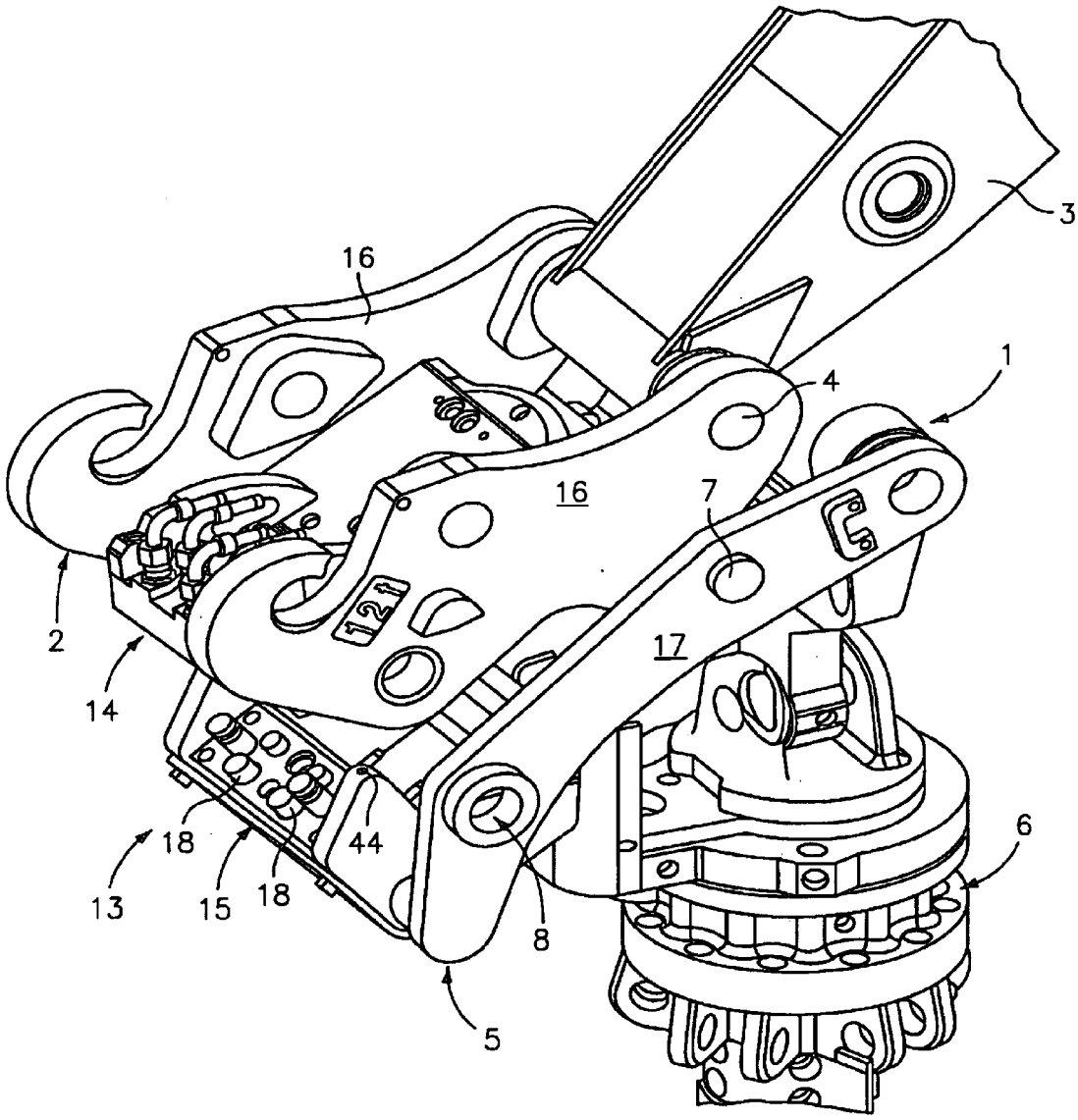
FIG. 1 a perspective view of a quick coupling in accordance with a preferred embodiment of the invention which has a pair of mechanical quick coupling parts and a hydraulic coupling, with the mechanical quick coupling parts only being in engagement with one of two latching axles and the hydraulic coupling not yet being coupled.

The quick coupling 1 shown in the Figures has a quick coupling part 2 at the boom side which is pivotally secured to the shaft 3 of a boom of a hydraulic excavator and which can be pivoted via a pivot flap not shown in any more detail in a manner known per se about the pivot axis 4 perpendicular to the longitudinal axis of the shaft 3. The quick coupling 1 further has a quick coupling part 5 at the tool side which is connected to a hydraulic excavator tool. This can, for example, be a grabbing tool with a rotating mechanism 6 which is hydraulically actuable.

The two parts 2 and 5 of the quick coupling 1 can be latched to one another via two parallel latching axles 7 and 8 which are spaced from one another and which can be latched together. The latching axles 7 and 8 extend, as FIG. 1 shows, parallel to the pivot axis 4 about which the quick coupling 1 can be pivoted relative to the shaft 3.

Figure 2:
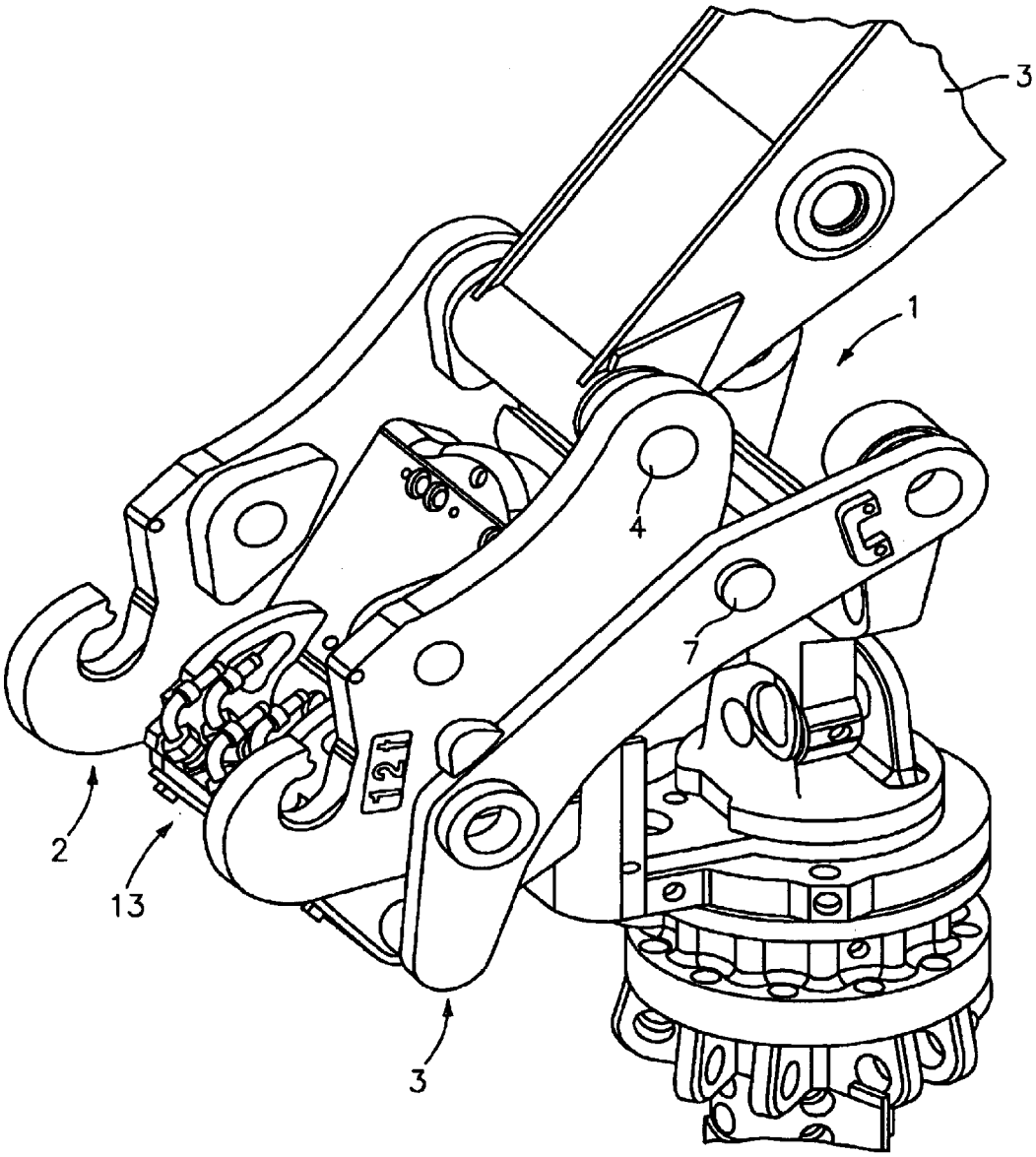
FIG. 2 a perspective view of the quick coupling from FIG. 1, with the quick coupling parts being shown in the pivoted together state with a coupled hydraulic coupling.

The first of the two latching axles 7 is formed on the one hand by a transverse bolt 9 provided at the quick coupling part at the tool side and by a pair of latching hooks 10 provided at the quick coupling part 2 at the boom side. The latching hooks 10 can be hooked in at the transverse bolt 9 so that this is engaged by the latching hooks 10 and the quick coupling part 5 at the tool side can be raised. As FIG. 2 shows, the latching hooks 10 are hook-like recesses open to one side which surround the transverse bolt 9 in the form of a half-shell. The hook recesses are in this connection open to the side of the quick coupling part 2 which is remote from the second latching axle 8.

Figure 3:
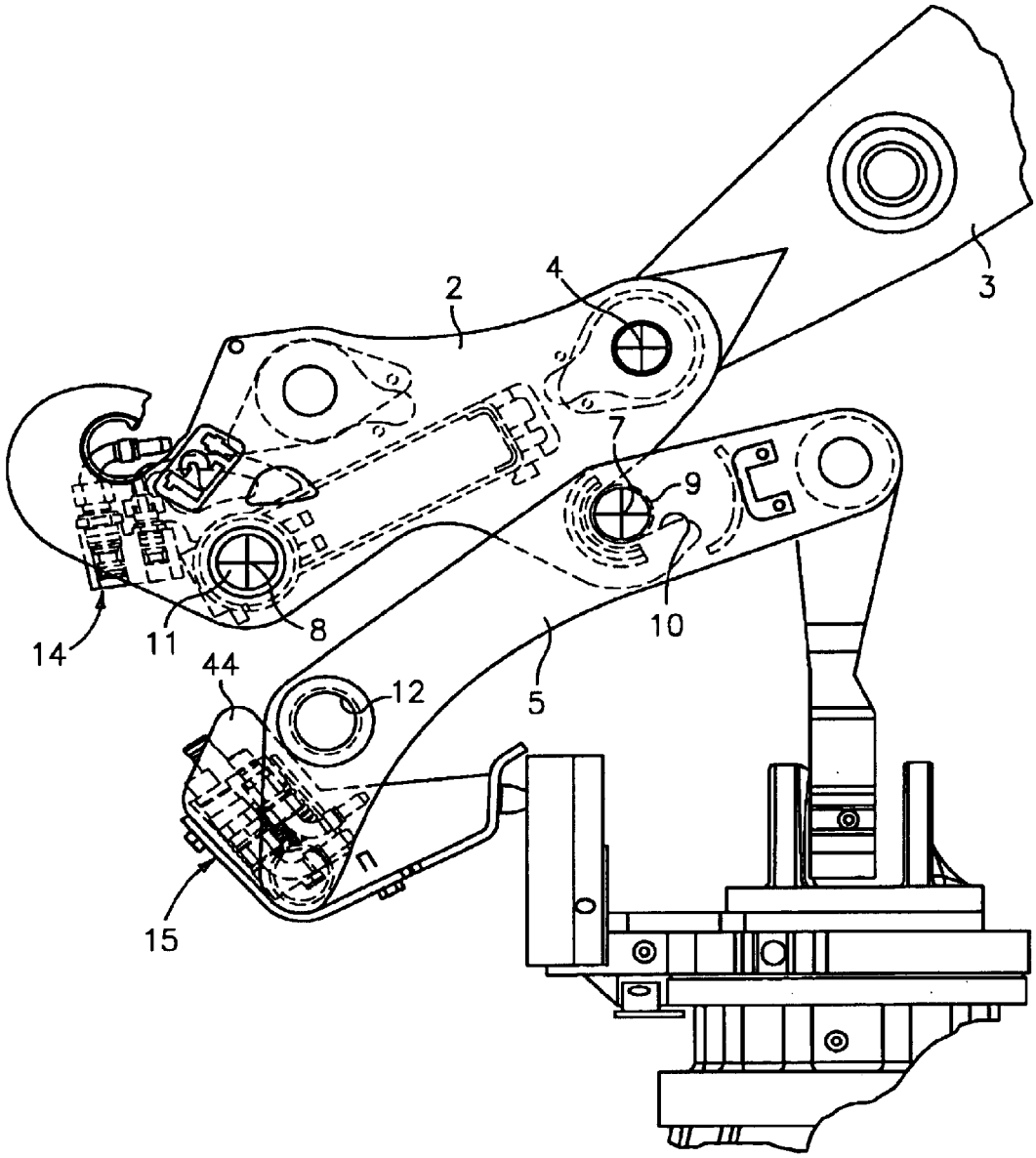
FIG. 3 a side view of the quick coupling from FIG. 1, with the quick coupling parts only being in engagement with one of two latching axles.

The second latching axle 8 is on the one hand formed by a latching bolt pair 11, which can be moved apart, and by an associated pair of latching bores 12. As FIG. 3 shows, the latching bolt pair 11 is arranged at the quick coupling part 2 at the boom side and can be moved in and out, preferably hydraulically, by a driving mechanism known per se. The latching bores 12 are formed in the quick coupling part 5 at the tool side. As can be seen from FIG. 1, both the quick coupling part 2 at the boom side and the quick coupling part 5 at the tool side have substantially vertical carrier members which are spaced apart from one another and indeed differently spaced apart from one another so that the carrier plates of the quick coupling part 2 at the boom side can be moved in between the carrier plates of the quick coupling part 5 at the tool side.

To couple the two quick coupling parts 2, the quick coupling part 2 at the boom side is first moved into the quick coupling part 5 at the tool side and the transverse bolt of the opposite quick coupling part is engaged by the hook-like latching recesses 10 (cf. FIG. 3). By a slight raising of the quick coupling part 2 at the boom side, it can be ensured that the quick coupling part 5 at the tool side securely falls into the hook-like latching recess 10. To latch the second latching axle 8, then the quick coupling part 2 at the boom side is pivoted about the pivot axis 4 so that as a result the two quick coupling parts 2 and 5 are pivoted together about the first latching axle 7. The two quick coupling parts 2 and 5 are pivoted together so far that the latching bolt pair 11 and the associated latching bores 12 coincide with one another. Then the latching bolts 11 are preferably moved apart by hydraulic action so that they move into the latching bores 12. The two quick coupling parts 2 and 5 are fixedly latched together by the two latching axles 7 and 8.

Figure 11:
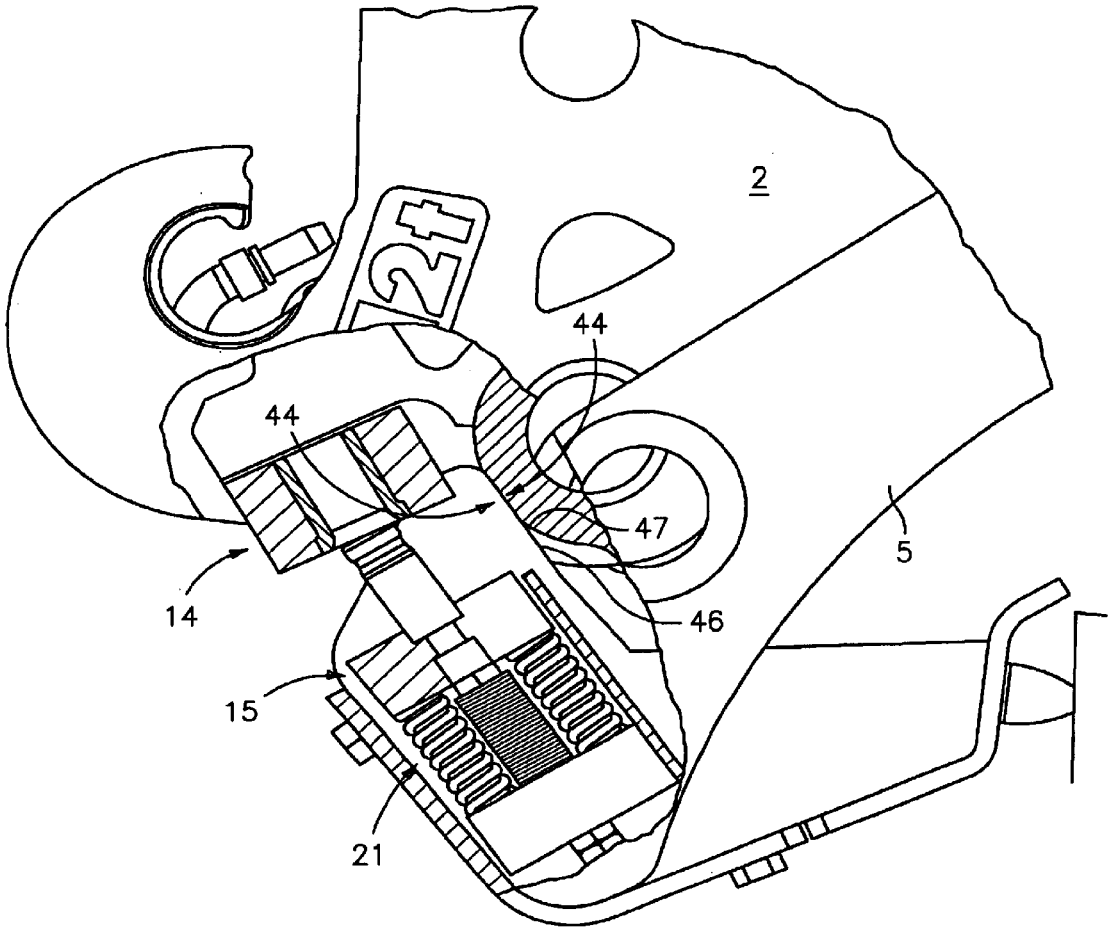
FIG. 11 an enlarged partly sectional view of a quick coupling similar to FIG. 4 which shows the hydraulic coupling shortly before its two power coupling parts enter into engagement with one another.

To prevent an offset of the two quick coupling halves and thus damage to the sensitive hydraulic coupling described in the following during the pivoting of the two quick coupling parts 2 and 5 about the first latching axle 7, the two quick coupling parts 2 and 5 can be provided with a pivot guide 44 (c.f. FIG. 11). The two solid quick coupling parts 2 and 5 each have a guide surface 46 and 47 (cf. FIG. 11), which can only be pushed over one another or past one another when the first latching axle 7 coincides properly. If, for example, an excavator driver does not drive the hook-like recess 10 in properly, the pivot guide prevents pivoting together with offset. The guide surfaces 46 and 47 can be made such that they have a centring effect, i.e. the two quick coupling parts 2 and 5 press into the properly aligned position when they are pivoted together.

To supply driving elements at the tool side with power, a hydraulic coupling 13, which connects a hydraulic circuit at the boom side to a hydraulic circuit at the tool side, is associated with the quick coupling 1. For example, the rotating mechanism 6 in accordance with FIG. 1 can be hydraulically operated. Further driving elements and accordingly a plurality of hydraulic circuits can be provided and coupled.

Figure 7:
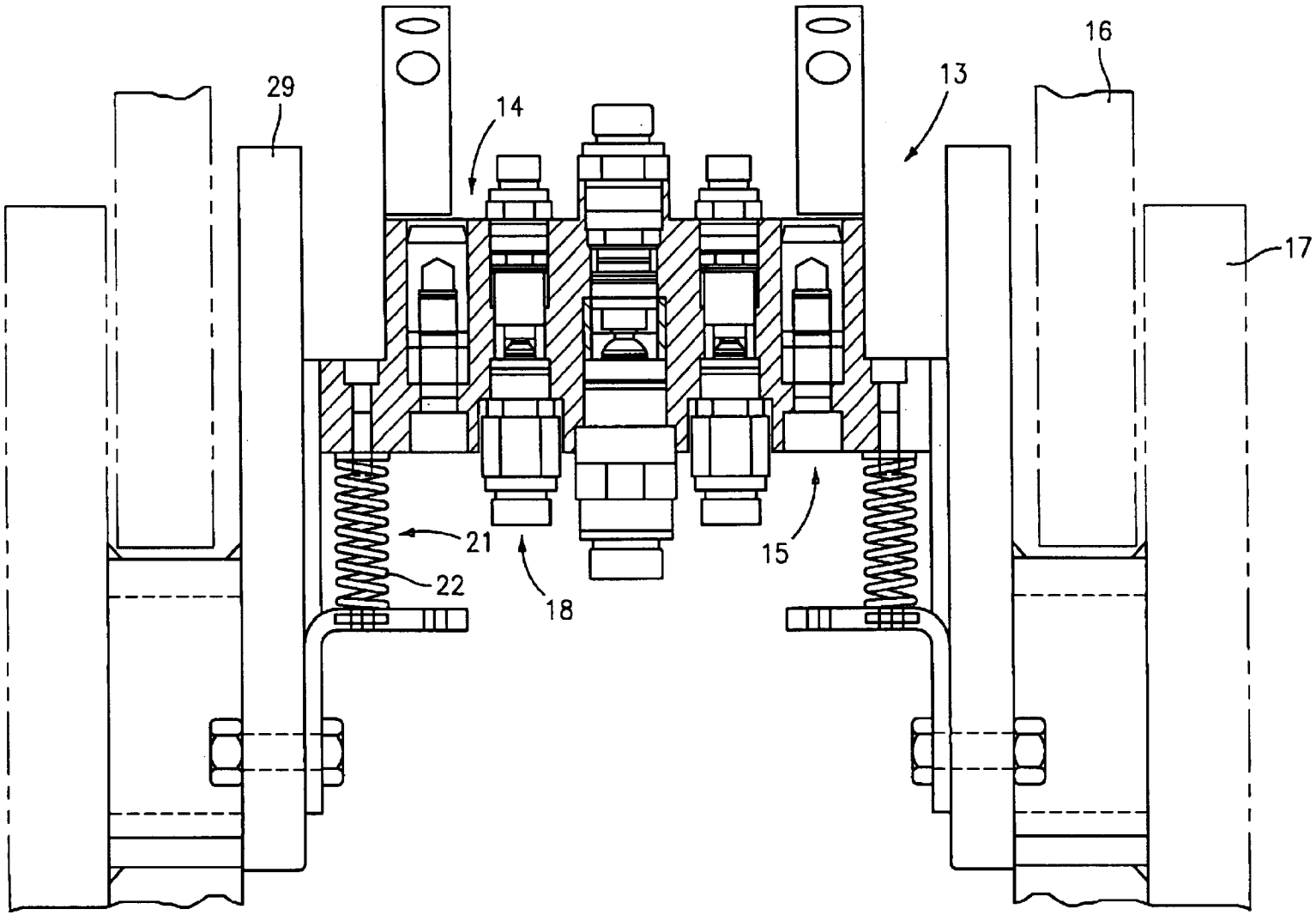
FIG. 7 a frontal view of the hydraulic coupling in sectional representation which shows the hydraulic coupling in the completely latched state.

The hydraulic coupling 13 comprises two power coupling parts 14 and 15 which are mounted to the quick coupling part 2 at the boom side at the one side and to the quick coupling part 5 at the tool side at the other side. They are arranged on the sides of the quick coupling parts 2 and 5 opposite the first latching axle 7 and 8, and indeed each at the same spacing from the first latching axle 7 so that they move on to one another on the pivoting together of the two quick coupling parts 2 and 5. They could generally also be arranged between the two latching axles 7 and 8. However, they preferably lie outside the region bounded by the two latching axles 7 and 8 since experience has shown that the latter is prone to contamination and is difficult to access. Due to the arrangement of the power coupling parts 14 and 15 outside the latching axles 7 and 8, these are less prone to faults and better to maintain. As FIGS. 1 and 7 show, the power coupling parts 14 and 15 are each arranged between the perpendicular carrier members 16 of the quick coupling part 2 at the boom side or the perpendicular carrier members 17 of the quick coupling part 5 at the tool side. They thus lie in a protected manner. They in particular do not protrude over the quick coupling parts 2 or 5 such that the power coupling parts 14 or 15 would be pressed into the ground when the corresponding quick coupling parts 2 are placed on the ground.

Both power coupling parts 14 and 15 encompass a plurality of power line couplings. They are each formed as a connector block in which a plurality of connector members 18 are collected together. As FIG. 7 shows, each of the two power coupling parts 14 and 15 has a plate-shaped carrier member 19 or 20 which in each case extends transversely to the corresponding quick coupling part 2 or 5. The connector members 18, which can be pushed together and which effect the hydraulic fluid connection, sit perpendicular to the carrier members 19 and 20. The connector members 18 can be connector members of a female and male kind known per se.

Figure 4:
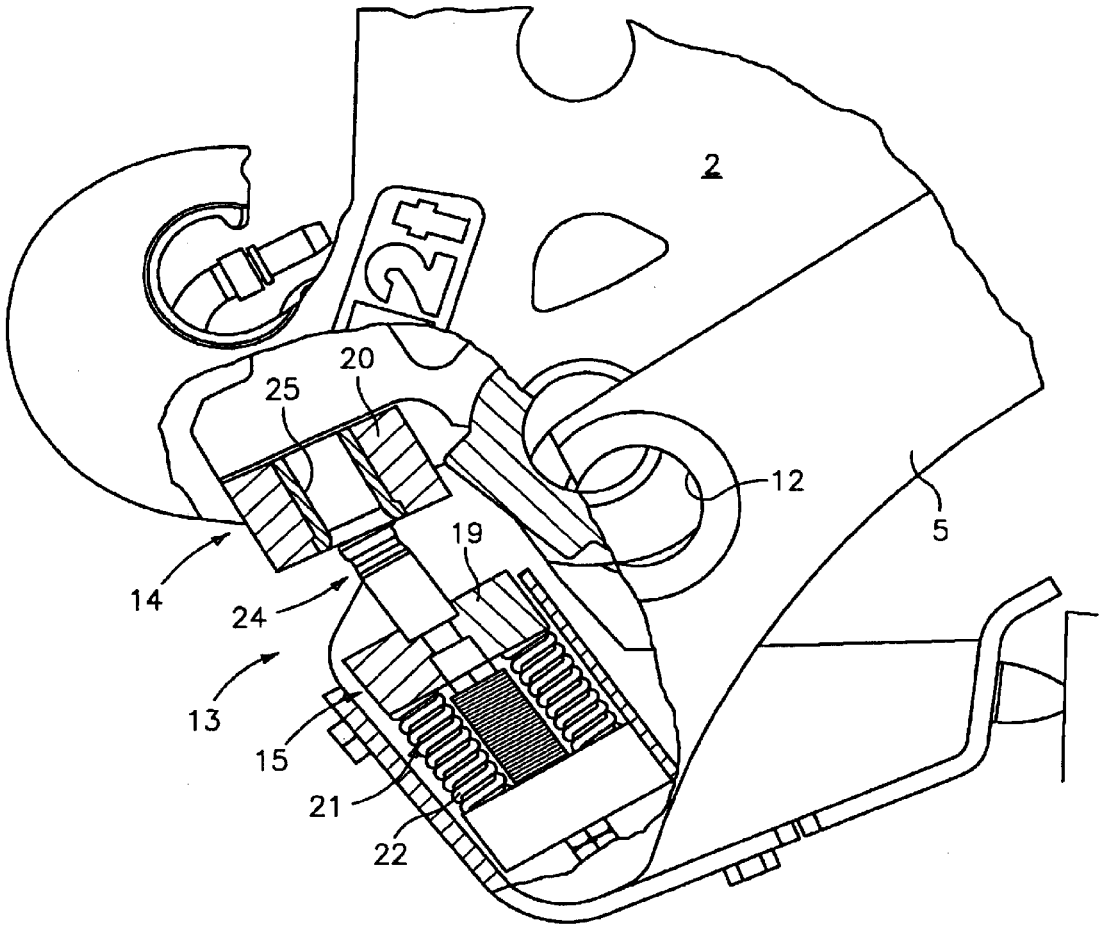
FIG. 4 an enlarged partly sectional view of the quick coupling which shows the hydraulic coupling shortly before its two power coupling parts enter into engagement with one another.
Figure 5:
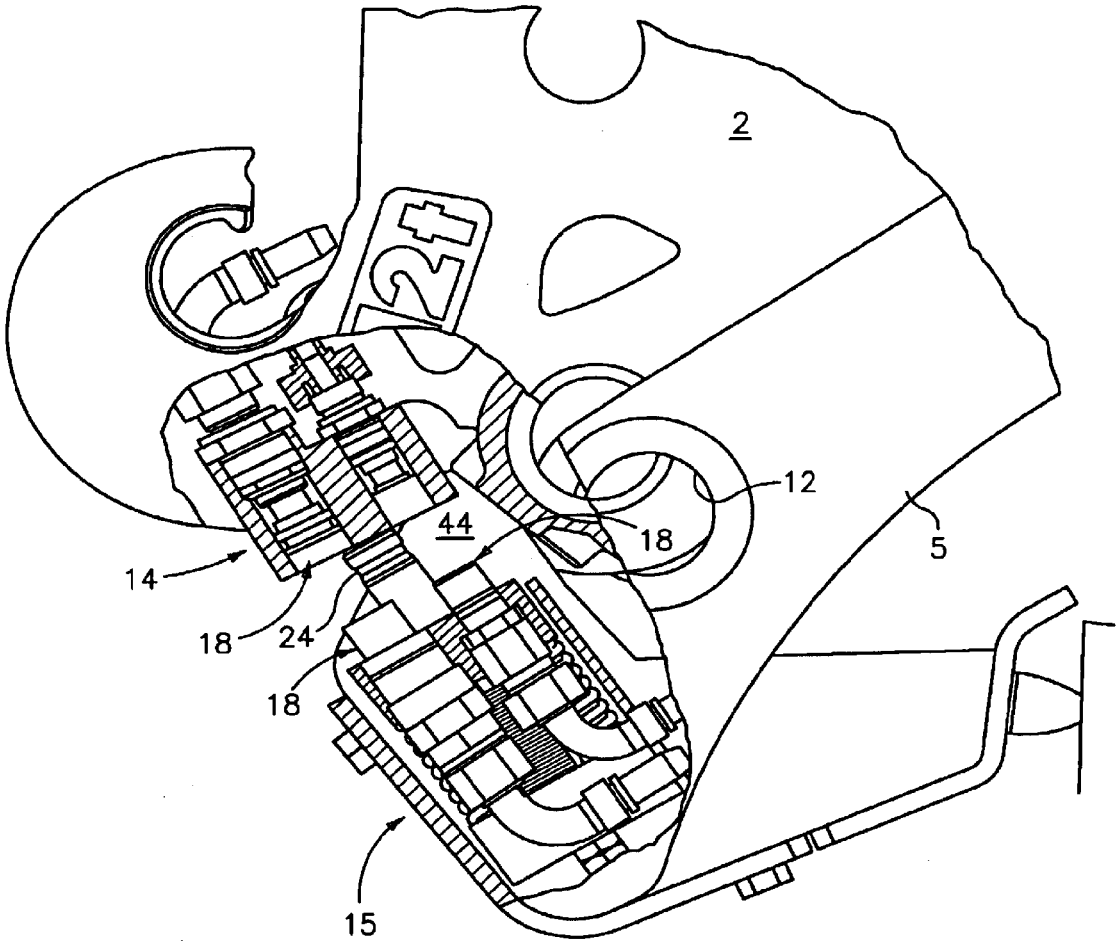
FIG. 5 a partly sectional view similar to FIG. 4, with the hydraulic coupling being shown in another sectional plane in which the female and male connector pieces of the coupling can be seen.

In accordance with the embodiment shown in FIGS. 1 to 7, the power coupling part 14 arranged at the quick coupling part 2 at the boom side is fixedly mounted, i.e. it is rigid relative to the quick coupling part 2. The power coupling part 15 secured to the quick coupling part 5 at the tool side is movably mounted to this. As FIG. 4 and FIG. 7 show, the whole power coupling part 15 is seated on a spring arrangement 21 which in the embodiment shown consists of four compression springs arranged in an oblong. The compression springs 22 are secured at one end to bracket plates which are arranged at the perpendicular carrier members 17 of the quick coupling part 5 at the tool side (cf. FIG. 7). At the other end, the cylindrical spring elements 22 are connected, preferably screwed, to the carrier member 20 of the power coupling part 15. The springs 15 have a sufficient height and elasticity so that the power coupling part 15 can be displaced or tilted in multi-axial fashion. The spring arrangement 21 forms a multi-axially movable mounting for the power coupling part 15 so that this can compensate an offset to the opposite power coupling part 14, in particular due to the pivot movement of the quick coupling parts 2 and 5.

Figure 6:
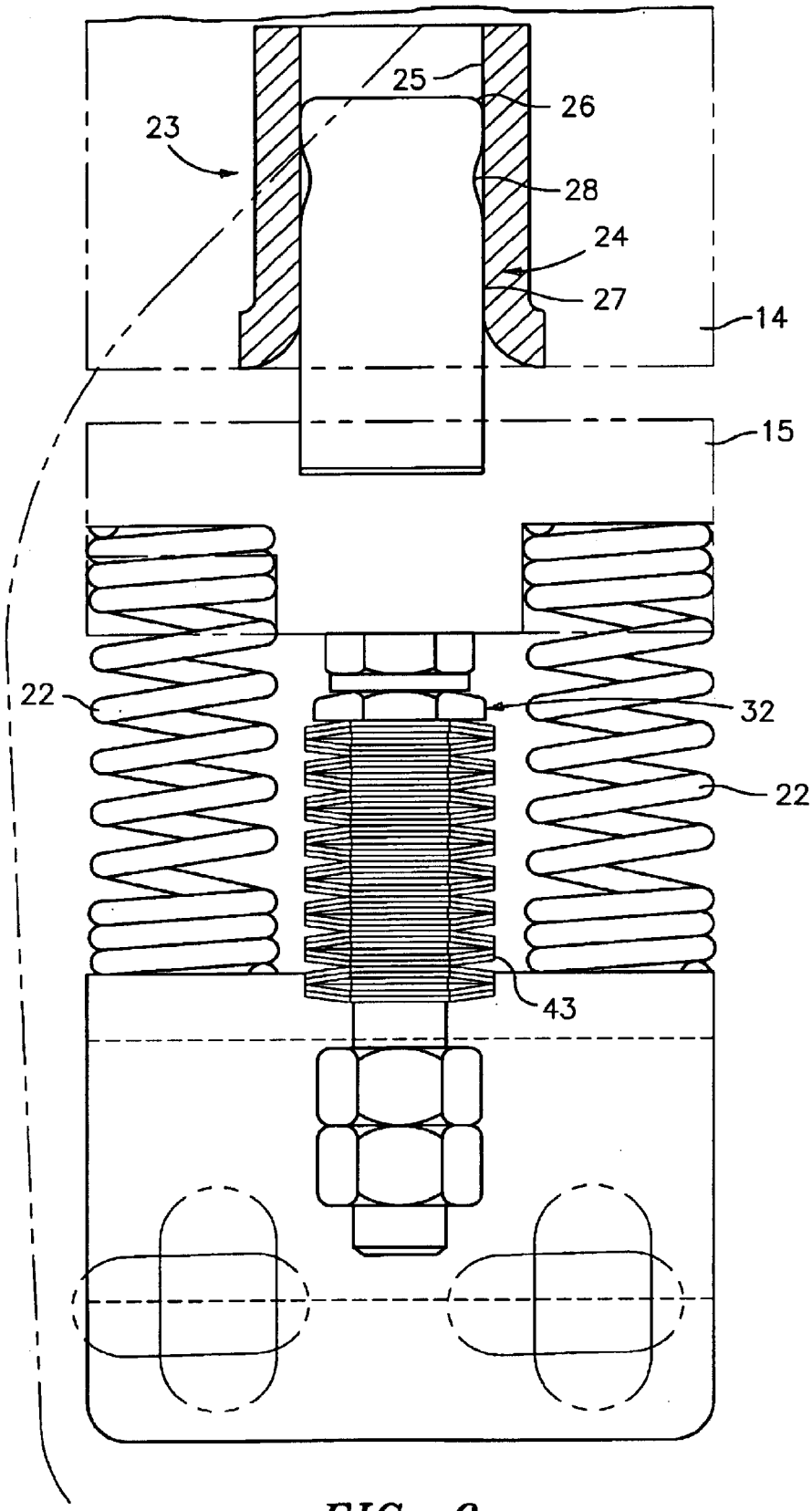
FIG. 6 an enlarged sectional view of the hydraulic coupling which shows the engagement of the linear guide of the hydraulic coupling shortly before the hydraulic coupling is completely coupled.

As can be seen from FIGS. 3 and 6, the two power coupling parts 14 and 15 automatically move through the pivot together movement of the quick coupling parts 2 and 5 and synchronously together with these. In this connection, the power coupling parts 14 and 15 undergo a circular movement about the first latching axle 7. Since the connector members 18, however, have to be moved together in a linear manner onto the two power coupling parts 14 and 15, the pivot movement of the power coupling parts 14 and 15 is compensated by means of the spring arrangement 21. To ensure an exactly linear movement, the hydraulic coupling 13 is associated with a linear guide 23 which ensures that the power coupling parts 14 and 15 are moved towards one another exactly along a straight line despite the pivot movement of the quick coupling parts 2 and 5. The linear guide 23 consists in the drawn embodiment of a pair of guide bolts 24 and associated guide bores 25 into which the said guide bolts 24 move during the moving together of the two power coupling parts 14 and 15. In this connection, they force the springs 22 to a deflection to compensate the pivot movement components. Furthermore, the offset as a consequence of tolerances in the assembly is compensated.

Figure 20:
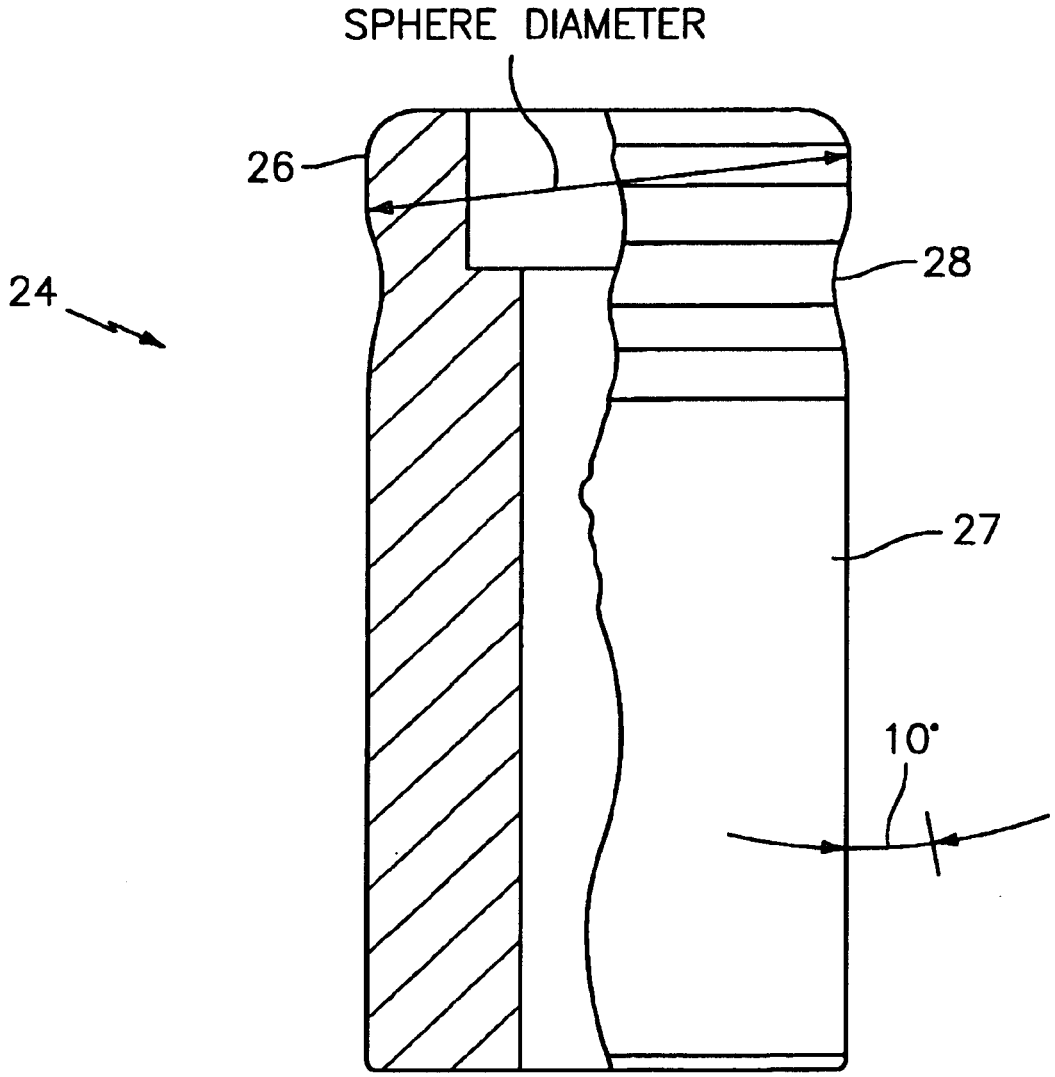
FIG. 20 a half-section through a guide bolt of the power coupling which forces a linear pushing together of the two power coupling parts.

The guide bolts 24 are rigidly connected to the carrier member 19 of the power coupling part 15 and project in perpendicular manner over this to the opposite power coupling part 14. Each guide bolt 24 is made essentially cylindrical. Specifically, however, each guide bolt 24 has a rounded head 26, a cylindrical guide section 27 and a constriction 28 interposed therebetween which separates the bolt head 26 from the cylindrical guide section 27. Due to the special design of the guide bolts 24, tilting during the insertion into the guide bores 25 is prevented. As FIG. 20 shows, the jacket surface of the guide bolt 24 can be spherically rounded in the region of the head 26. The spherical rounding merges into the constriction 28. It can additionally be provided that the cylindrical shaft part or guide section 27 has a conical incline which can be in the range from 5 to 15 degrees, preferably approximately 10 degrees. The specific shape of the guide bolt, in particular the spherical form of the head, allows a tilt-free insertion of the guide bolts into the opposite guide bores. In the region of their opening cross-section, the guide bores 25 can have a cross-section widening in the form of a chamfer, a rounding or the like to facilitate the threading in (cf. FIG. 4). The guide bolts 25 or the female guides 28 are preferably formed from suitable material and are inserted into the power coupling part 14 at the boom side.

Figure 10:
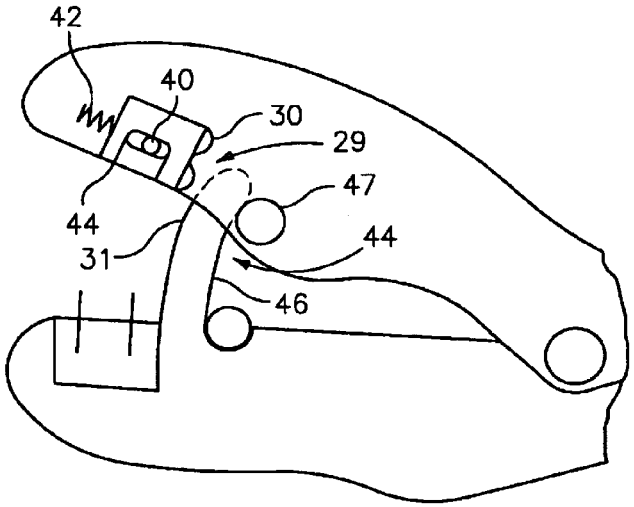
FIG. 10 a side view of a quick coupling in accordance with a further embodiment of the invention, in which a pre-centring means of the movably mounted power coupling part is provided via a cam-like pre-centration surface on the pivoting together of the quick coupling parts.

To prevent the guide bolts 24 from not fitting into the guide bores 25 due to excessive offset when the quick coupling parts 2 and 5 are moved together, a pre-centering means 29 can be provided for the pre-centering of the two power coupling parts 14 and 15 relative to one another. FIG. 10 shows an example of such a pre-centering means 29. At the one end, the movably mounted power coupling part 15 can have a centering surface 30. At the oterh end, a cam-shaped centering surface 31 can be provided at the opposite quick coupling part on which the centering surface 30 of the power coupling part 15 slides off when the two quick coupling parts 2 and 5 are moved together. The pre-centering means has the effect that the two power coupling parts 2 and 5 are moved together. The pre-centering means has the effect that the two poer couplings parts 14 and 15 are in an at least roughly aligned position to one another when they are moved apart.

To achieve a reliable and complete moving together of the connector members 18, an actor is preferably provided which becomes active on the last part of the path of the pivot together movement of the quick coupling parts 2 and 5 and presses the two power coupling parts 14 and 14 completely onto one another. A pressure ram 32 can in particular be provided on which the spring-mounted power coupling part 15 is seated (cf. FIG. 6). Since the springs must be sufficiently elastic to compensate the pivot movement or offset, they could yield and be pressed together so that no complete coupling of the hydraulic coupling takes place. The pressure ram 32 acts as a limiter for the spring path of the spring mounting. As FIG. 6 shows, the head of the pressure ram 32 is preferably slightly rounded so that even with a lightly inclined position of the movably mounted power coupling part 15 the pressure ram 32 sits as centrally as possible. The pressure ram 32 can likewise be made in a resilient manner. As FIG. 6 shows, the pressure ram 32 can be a bolt mounted in a longitudinally displaceable manner which is biased by means of a compression spring 43 which can be made in the form of a spring washer set. The spring hardness of the pressure ram 32 is expediently substantially larger than that of the spring arrangement 21 for the movable mounting of the one power coupling part 15. As FIG. 6 shows, the power coupling part 15 is seated on the pressure ram 32 towards the end of the moving together movement. Said pressure ram then presses the movably mounted power coupling part 15 completely onto the opposite power coupling part 14 during the remaining pivoting together of the quick coupling parts 2 and 5. It is ensured in this way that a complete coupling of the hydraulic coupling is achieved. In accordance with an alternative embodiment of the invention, the pressure ram 32 can be a hydraulically actuable ram. For this purpose, the arrangement can be turned around, i.e. the movably mounted power coupling part is preferably arranged at the quick coupling part 2 at the boom side so that the pressure ram can be supplied from the hydraulic system on the boom side. With the pressure ram which can be moved out hydraulically, an increased force can be applied in particular towards the end of the coupling movement.

Figure 15:
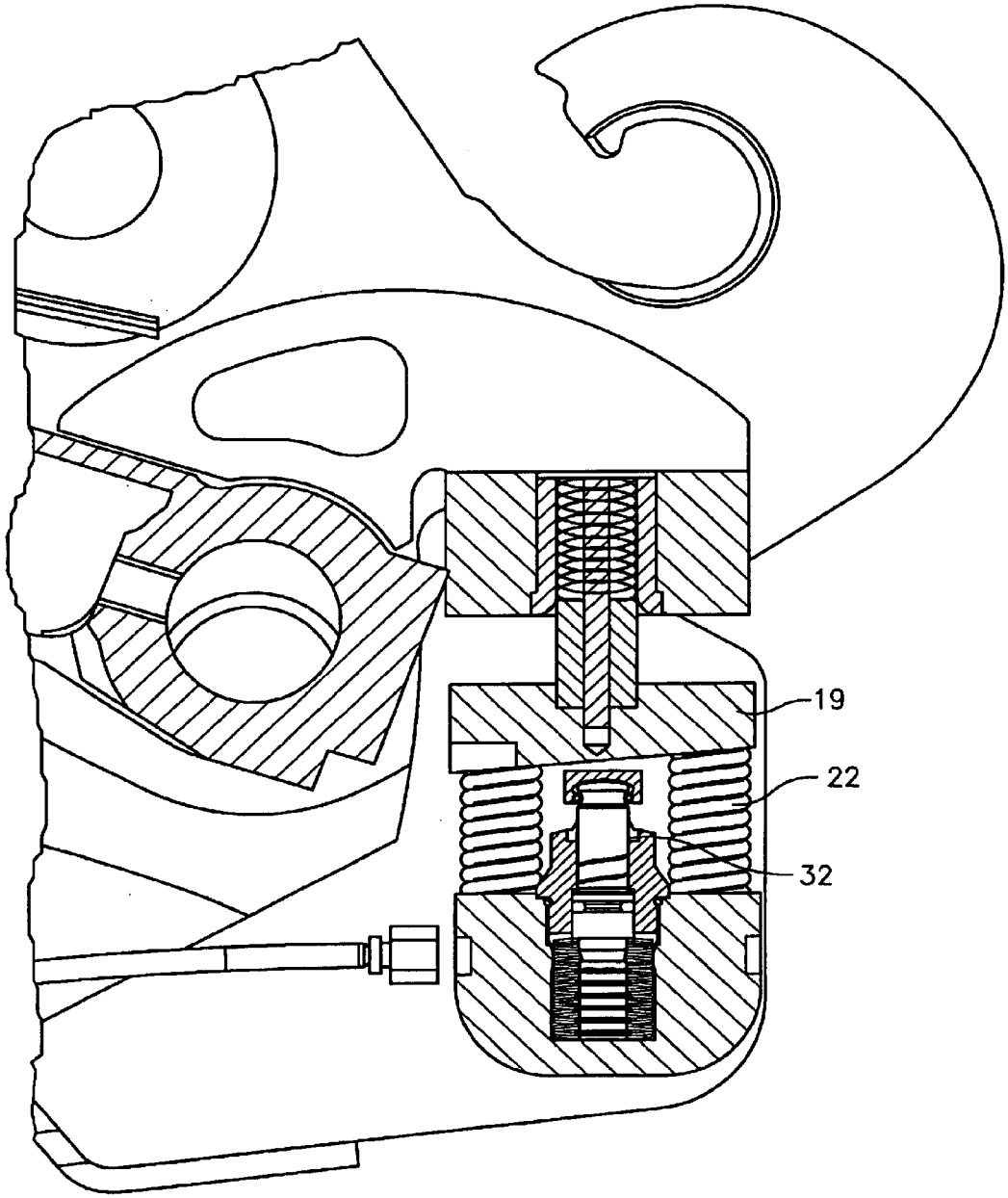
FIG. 15 a partly sectional view similar to FIG. 4 of a further embodiment of the quick coupling which shows the hydraulic coupling with a hydraulically actuable pressure ram shortly before the coupling couples.
Figure 16:
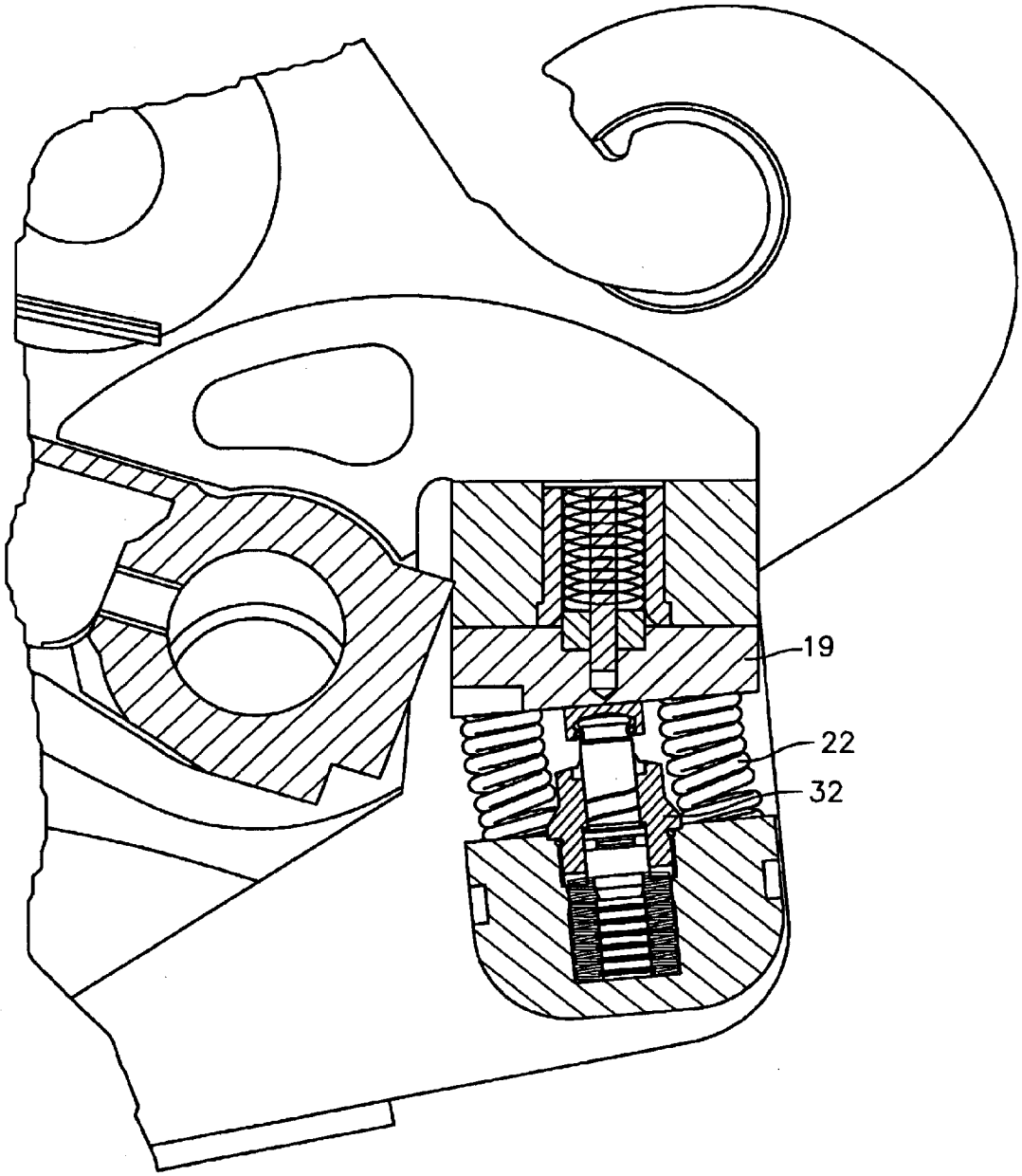
FIG. 16 a partly sectional view similar to FIG. 15, with the hydraulic coupling being shown in the completely moved together state.

FIGS. 15 to 18 show an advantageous embodiment of the hydraulic coupling with a hydraulically actuated pressure ram. The power coupling parts are generally mounted movably or resiliently in the previously described manner so that reference is made to the preceding description. As FIG. 15 shows, the pressure ram is moved into its starting position so far that there is air between the plate-like carrier member 19 and the end face of the pressure ram 32. The power coupling therefore initially threads in with the aid of the springs 32 or of the force applied thereby, with the linear guide ensuring that the two power coupling parts move perpendicularly on to one another. In this connection, an elastic deformation of the mounting springs is created, as FIG. 16 shows.

Figure 17:
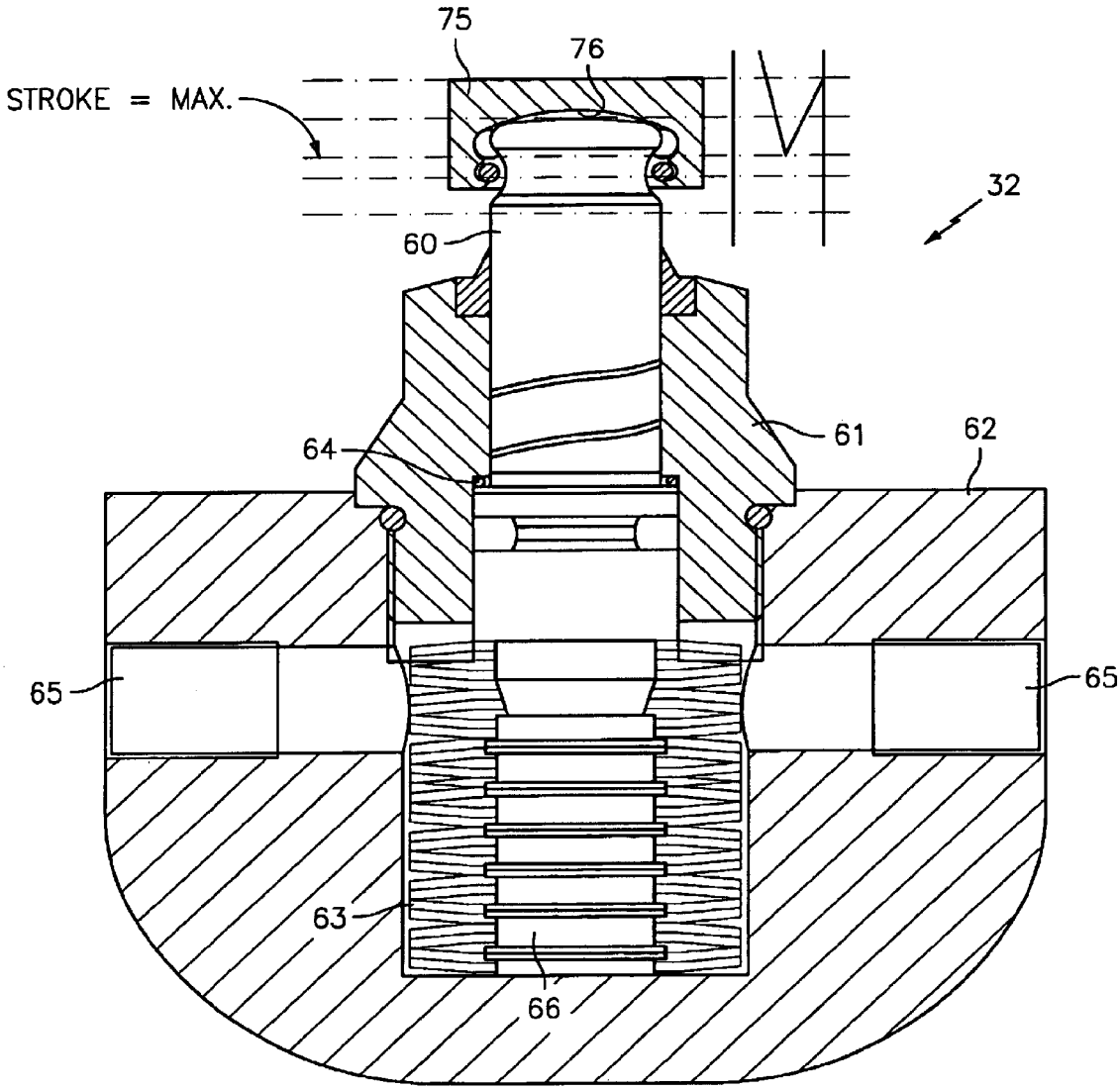
FIG. 17 an enlarged partly sectional view of the hydraulic pressure ram from the two preceding Figures.
Figure 18:
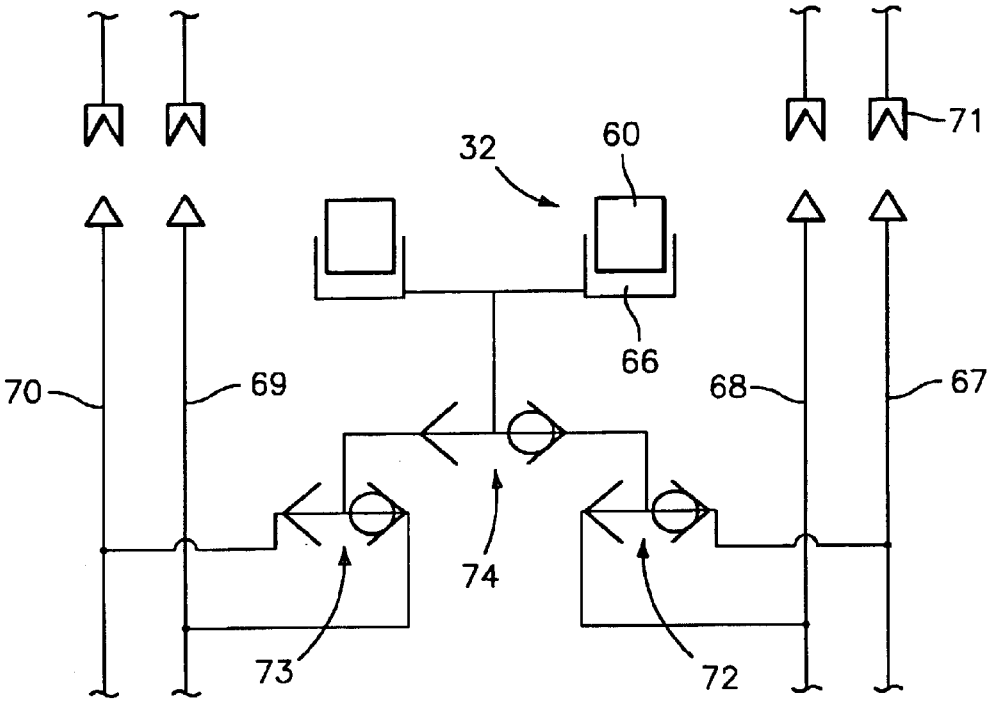
FIG. 18 a schematic representation of the circuit for actuating two hydraulic pressure rams in accordance with the embodiment of the three preceding Figures.

In order to hold the two power coupling parts together reliably in operation even with large forces, the hydraulic pressure ram 32 is provided which presses centrally against the carrier member 19 so that this is pressed tightly against the carrier member 20 at the boom side. Two or more hydraulic pressure members 32 can be provided. As FIG. 17 shows, the pressure ram 32 comprises a piston-in-cylinder unit which consists of a plunger piston 60 and a cylinder liner 61 displaceably guiding the plunger piston 60. The cylinder liner 61 is screwed into the carrier member 62 of the power coupling fixed to the tool in a manner impermeable to fluid. As FIG. 17 shows, the plunger piston 60 is biased by a spring unit 63, and indeed in its moved out position in which it moves towards a shoulder at the cylinder liner side by means of a shoulder 64. Disc springs of suitable thickness can be provided as the spring unit 63. The disc springs are dimensioned such that they can yield when the power coupling parts are moved together. The play-free, fixed holding together under all operating conditions is achieved by the hydraulic action on the plunger piston 60. For this purpose, the plunger piston 60 or a pressure chamber 66 is connected to the hydraulic lines of the tool via a pressure fluid bore 65. As FIG. 18 shows, four pressure medium lines 67, 68, 69, 70 are guided in the embodiment drawn by means of connectors 71 of the power coupling from the boom side to the tool side of the quick coupler. The pressure medium lines 67 to 70 at the tool side are all connected to the pressure chamber 66 of the pressure ram 32. In this connection, the pressure medium lines 67 to 70 are each collected together in pairs via shuttle valves 72, 73 and 74. The shuttle valves in the form of double check valves ensure that always that pressure medium line is asserted from the pressure medium lines 67 to 70 which has the highest pressure. Therefore, always that pressure is applied in the pressure chamber 66 of the pressure ram 32 which is the largest of the pressures prevailing in the pressure medium lines 67 to 70.

The effective area of the plunger piston which effects its adjusting force is in this connection larger than the sum of the cross-section areas of the connectors 71. It is ensured in this way, in conjunction with the circuit which always gives the greatest pressure to the plunger pistons, that the holding together force is always greater than the forces effected by the pressures in the connectors which want to press the power coupling apart.

As FIG. 17 shows, a pressure cap 75 sits on the plunger piston 60 at the end face which has an essentially planar end face. It is ensured in this way that it always contacts the carrier member plate 19 areally and excessive areal presses such as would occur with a spot-like contact are avoided. To nevertheless allow a tilt movement, the connection surfaces 76 at which the end face of the plunger piston 60 and the pressure cap 75 contact one another are rotationally symmetrically rounded surfaces so that a tilt movement is possible between the pressure cap and the plunger piston 60. Nevertheless, the contact between the plunger piston 60 and the pressure cap 75 is also areal.

In operation, as already mentioned, large forces can occur in part which could press the power coupling parts apart. To provide a remedy here, optionally a form-locked latching of the power coupling parts 14 and 15 can also be provided.

Figure 12:
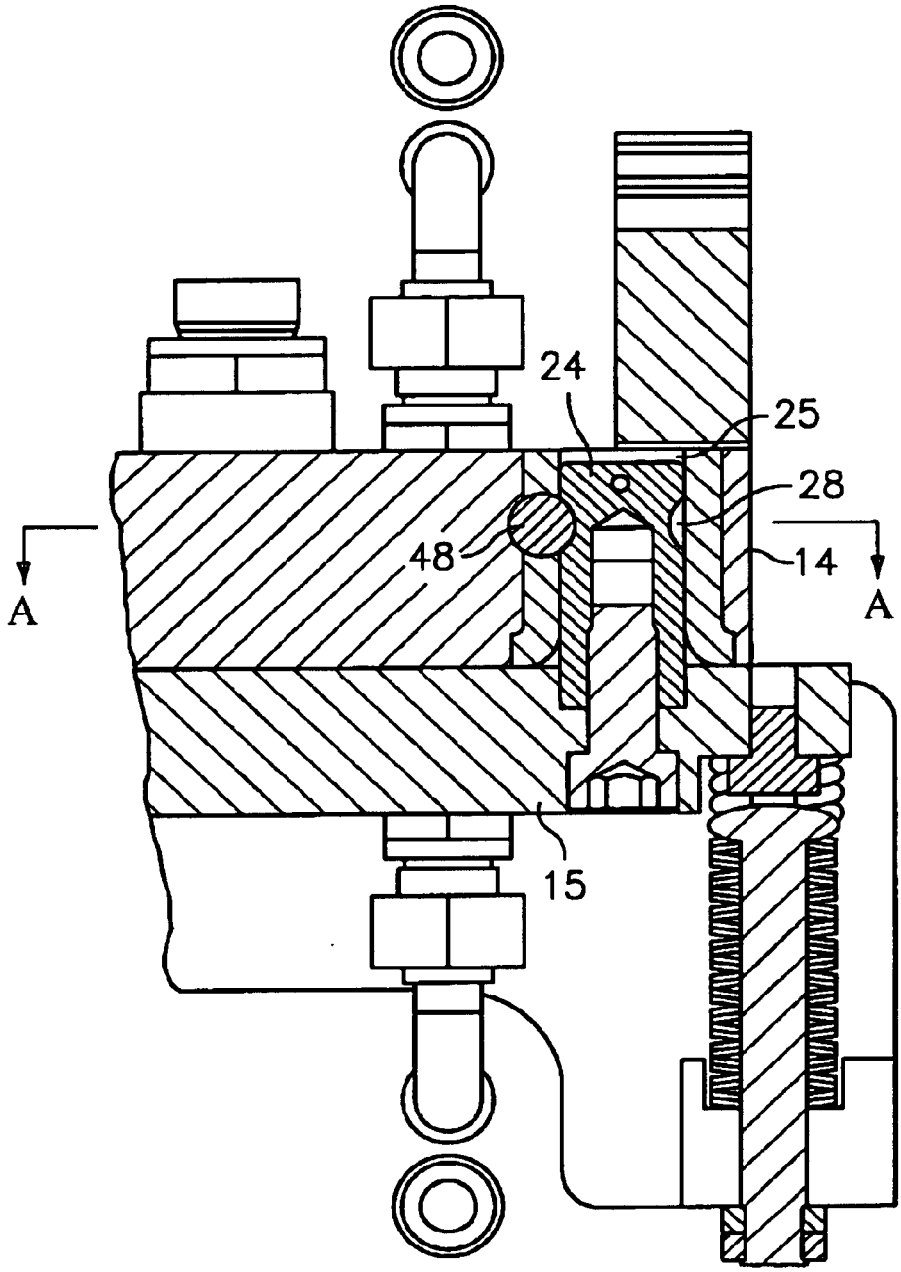
FIG. 12 a section-wise frontal view of a hydraulic coupling in sectional representation similar to FIG. 7 which shows the hydraulic coupling in a completely latched state, with the guide bolt of the one power coupling part being secured by a transverse bolt in the other power coupling part.
Figure 13:
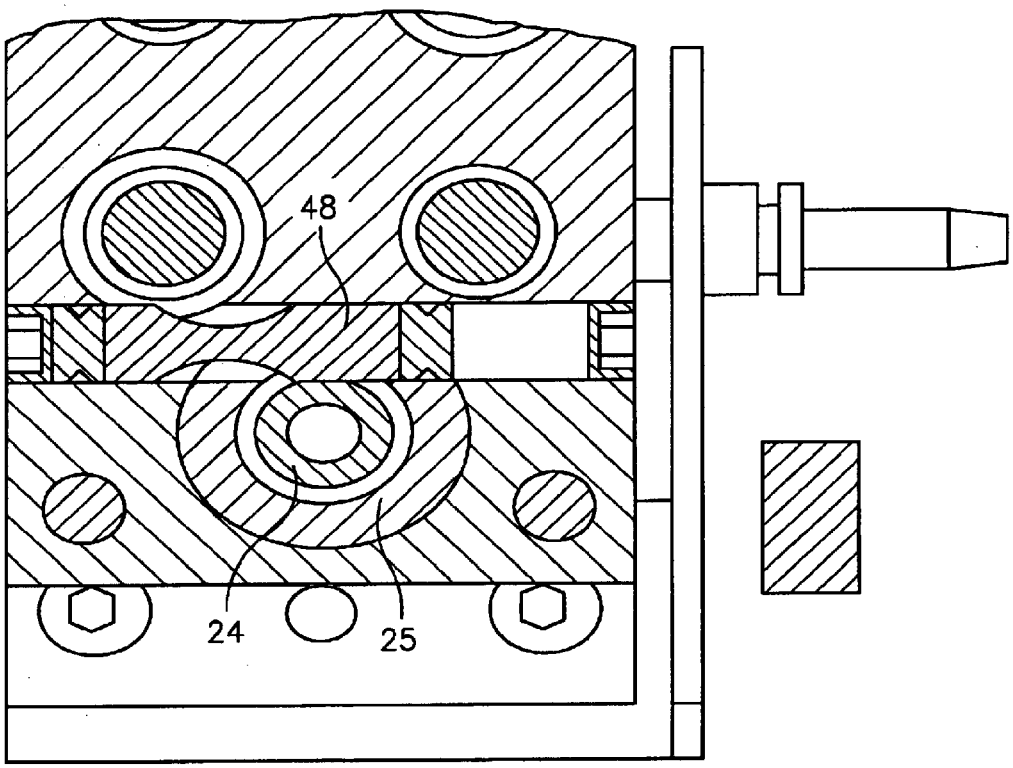
FIG. 13 a section-wise sectional view along the line A—A in FIG. 12.

As FIGS. 12 and 13 show, a displaceably mounted transverse bolt 48 can be provided in the power coupling part 14. The transverse bolt 48 is arranged such that it can move tangentially into the guide bore 25, and indeed in the region in which the constriction 28 of the guide bolt 24 comes to rest when the guide bolt is completely pushed in. As FIG. 13 shows, the transverse bolt 48 can have sections of different diameter. If the bolt is inserted into the guide bore 25 with a section of large diameter, the guide bolt 24 is latched. If the transverse bolt 48 is pushed into the guide bore 25 with a section of narrowed diameter, the guide bolt 24 can be pushed in and out. The transverse bolt 48 is preferably hydraulically actuable. Optionally, it can be biased in its latching position by means of a spring so that a hydraulic actuation only has to take place for unlatching.

Figure 14:
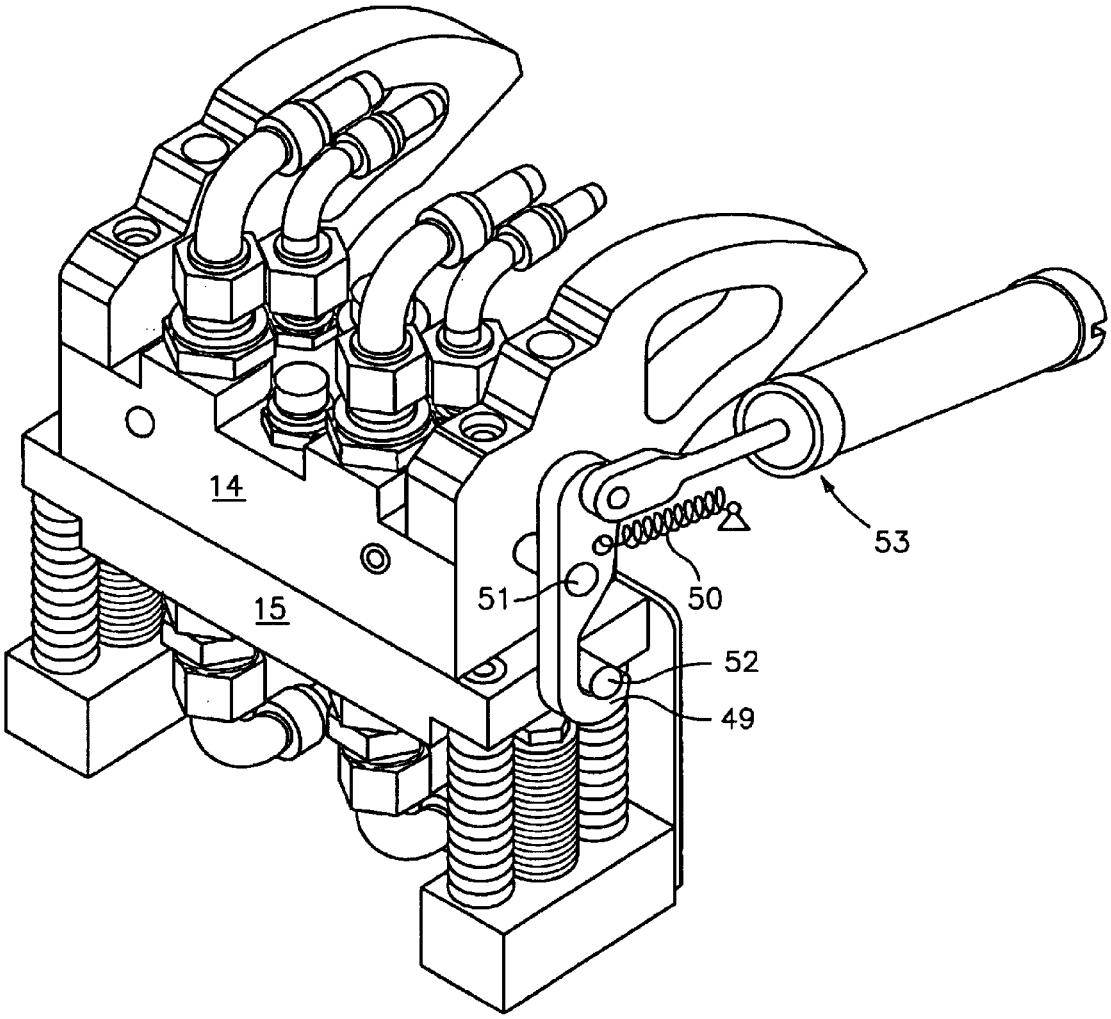
FIG. 14 a perspective view of the hydraulic coupling in the latched state, with the two power coupling parts being latched in form-locking manner by means of a pivotally mounted bar.

Furthermore, a bar 49 can be provided which latches the power coupling parts 14 and 15 together in form-locking manner (cf. FIG. 14). In a further development of the invention, the bar 49 can be formed as a rocker which is pivotally mounted about a pivot axis 51 at the power coupling part 14. It has a cranked hook at its one end with which it can engage behind a latching projection 52 at the opposite power coupling part 15. The bar 49 is preferably biased into its latching position by means of a spring 50. In addition, a hydraulic cylinder 53 is hinged to the bar 49 to pivot it into its unlocking position (cf. FIG. 14). The hydraulic cylinder 53 is preferably arranged at the boom side to be permanently connected to the hydraulic system there.

Figure 8:
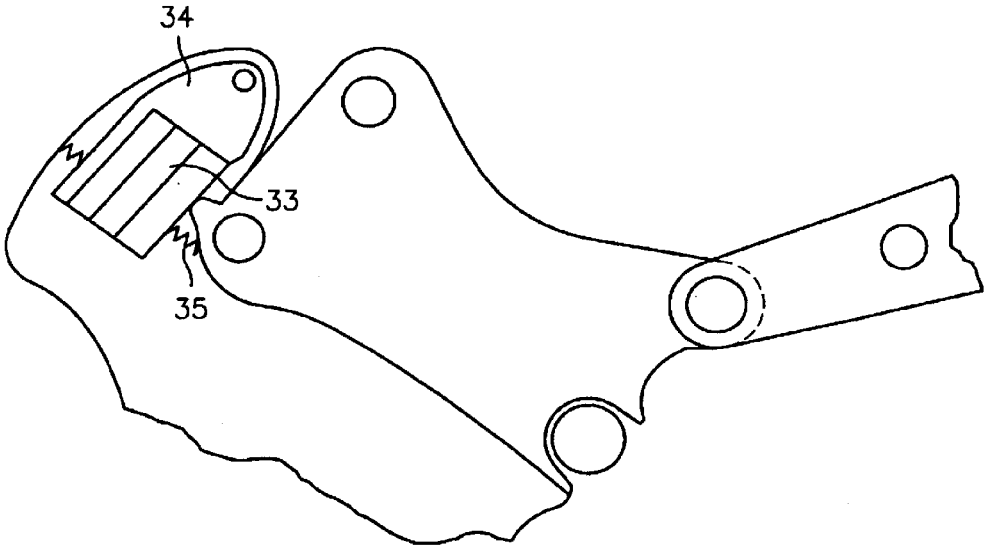
FIG. 8 a quick coupling in accordance with another preferred embodiment of the invention, in which both power coupling parts of the hydraulic coupling are movably mounted.

FIG. 8 shows an alternative mounting of the power coupling parts 14 and 15. Here, both power coupling parts are movably mounted. The power coupling part 14 secured to the quick coupling part 2 at the boom side is pivotally seated about a transverse axis 33 on a pivot flap 34. The pivot flap is in turn pivotally mounted at the quick coupling part about a pivot axis 35 parallel to and spaced from the transverse axis 33. Optionally, a neutral position of the power coupling part 14 can be ensured by means of a spring device.

The second power coupling part 15, which is secured to the quick coupling part 5 at the tool side is likewise movably mounted. In the embodiment drawn, it is mounted in a longitudinally displaceable manner, and indeed in a plane which is parallel to the first latching axle 7 of the quick changer 1. In accordance with FIG. 8, the second power coupling part 15 is movable from left to right. It is held in its neutral position by the springs 35.

Figure 9:
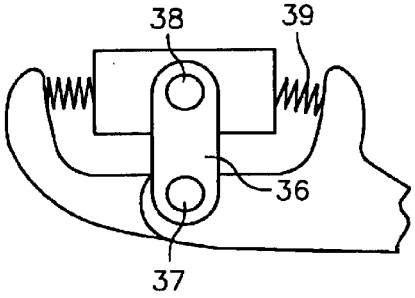
FIG. 9 a detailed view of a power coupling part pivotally mounted at a pivotal flap in accordance with another preferred embodiment of the invention.

FIG. 9 shows an alternative movable mounting of the power coupling part 15 provided at the tool side. It is seated on a pivot flap 36 which can be pivoted about a transverse axis 37 towards and away from the first latching axle 7. The power coupling part 15 is itself seated on the pivot flap 36 likewise pivotal about the tilt axis 38. The tilt axis 38 extends parallel to the axis 36, as FIG. 9 shows. The power coupling part 15 is held in its neutral position on the pivot flap 36 by means of springs 39.

FIG. 10 shows a further alternative coupling of the power coupling part 14 which is secured to the quick coupling part 2 on the boom side. It is seated in tiltable fashion on a transverse bolt 40 which extends parallel to the first latching axle 7. In addition, the power coupling part 14 is mounted displaceably on the bolt 40. It has an elongate hole 41 so that it is displaceable transversely to the bolt 40. The power coupling part 14 is held in its neutral position by means of a spring 42. In addition, the previously already described pre-centring means 29 is provided which pre-centres the power coupling part 14 when this is moved onto the opposite power coupling part 15 when the two power coupling parts 2 and 5 are pivoted together.

The upwardly projecting tine at the lower quick coupling part at which the pre-centring cam surface 31 is provided has a double function. It namely simultaneously forms the pivot guide 44 which forces the two quick coupling parts towards one another into their properly aligned position, The reference numerals 46 and 47 also designate the corresponding guide surfaces here.

Further mounting types of the movable power coupling part(s) are possible without these being represented separately. For instance, a resilient mount can be reached, for example, when the springs of the spring arrangement 21 shown in FIGS. 1 to 7 are replaced by elastic elements, e.g. rubber elements. Furthermore, it would be possible, instead of a self-adjusting mounting, to provide a compulsory mounting for at least one of the power coupling parts so that this compensates the pivot movement of the quick coupling parts 2 and 5 and an exactly linear movement is achieved between the two power coupling parts.

Considerable advantages can be achieved with the quick changer shown. The latching of the hydraulic coupling is in particular also ensured simultaneously with the quick changer latching. In addition, the hydraulic coupling 13 can also be retrofitted to existing quick changers, in particular due to its shown arrangement and positioning, as it is not integrated, but adapted. The positioning of the hydraulic coupling 13 allows good accessibility for maintenance and repair. In addition, due to the adaptation of the couplings to the quick changer, their size is variable and adaptable to the circumstances. A plurality of hydraulic lines can in particular be collected together in a single coupling block.

Figure 19:
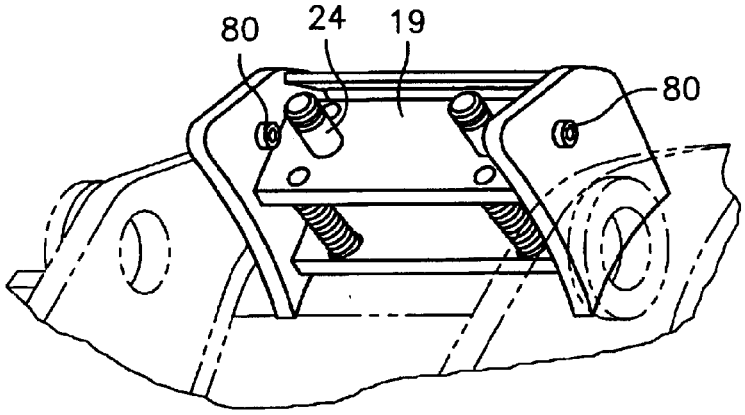
FIG. 19 a perspective view of the lower, movably mounted part of the hydraulic coupling from the preceding Figures.

To prevent the resilient mounting of the one power coupling part from being excessively pulled apart on the moving apart of the quick coupling, a stop 80 can be provided. As FIG. 19 shows, the stop 80 can be formed by two projections towards which the elastically mounted carrier member plate 19 moves on the pulling apart. The stops 80 are preferably arranged centrally, i.e. the line defined by them goes centrally through the guide bolts 24 of the power coupling.

What is claimed is:

1. A quick coupling (1) for coupling a tool to a boom (3), comprising a quick coupling part (2) at a boom side and a quick coupling part (5) at a tool side which can be latched together via a pair of spaced latching axles (7, 8) in such a way that after engagement of only a first one (7) of said two latching axles (7,8), the two quick coupling parts (2, 5) are rotated towards each other about said first latching axle (7) and then said second latching axle (8) is locked, and a power circuit coupling (13), for automatic coupling of a power connector at the tool side to a power connector at the boom side, wherein the power circuit coupling (13) has a power coupling part (14) at the boom side and a power coupling part (15) at the tool side which are arranged at the quick coupling part (2) at the boom side and the quick coupling part (5) at the tool side, such that said power coupling parts (14, 15) are brought together on a circular path about said first latching axle (7) by rotating said two quick coupling parts (2, 5) about said first latching axle (7), thus automatically coupling said two power coupling parts (14, 15);

at least one of said two power coupling parts (14, 15) is mounted pivotable about an axis parallel to said first latching axle (7) and movable in a direction perpendicular to said first latching axle (7), and a linear guide (23) is associated with the power circuit coupling (13) which compensates the pivoting movement of the two power coupling parts (14, 15) when bringing said two power coupling parts (14, 15) together on the circular path about said first latching axle (7) and urges said two power coupling parts (14, 15) to a pure linear movement relative to each other on a straight line when coupling.

2. A quick coupling in accordance with claim 1, wherein the linear guide (23) has at least one guide element (25) at the boom side and at least one guide element (24) at the tool side which enter into engagement with one another on closing of the power circuit coupling (13).

3. A quick coupling in accordance with claim 2, wherein there are provided as guide elements (24, 25), at least one guide bolt (24) at one of the power coupling parts (15) and at least one guide bore (25) at the other power coupling part (14) to receive the respective guide bolt (24).

4. A quick coupling in accordance with claim 3, wherein the guide bolt (24) can be secured in position and pushed into the guide bore (25) by a movable transverse bolt (48), which is mounted in the power coupling part (14) having the guide bore (25).

5. A quick coupling in accordance with claim 1, wherein only one of the two power coupling parts is movably mounted relative to the corresponding quick coupling part.

6. A quick coupling in accordance with claim 1, wherein both power coupling parts are movably mounted relative to the corresponding quick coupling parts (2,5).

7. A quick coupling in accordance with claim 1, wherein one (15) of the two power coupling parts (14,15) is movably mounted on a spring device (21).

8. A quick coupling in accordance with claim 1, wherein in a pressure ram (32) is provided on which one (15) of the two power coupling parts (14,15) is at least one of tiltably and displaceably seated.

9. A quick coupling in accordance with claim 8, wherein the pressure ram (32) has a bolt mounted in a longitudinally displaceable manner and biased by a spring (43).

10. A quick coupling in accordance with claim 8, wherein the pressure ram (32) has a dispaceably mounted piston (60) which can be acted upon by pressure medium.

11. A quick coupling in accordance with claim 10, wherein the piston (60) is acted on by a pressure medium from a circuit to be coupled, with an area ratio of effective area of said pressure ram (32) acted on by pressure medium, relative to effective connector surface acted on in a region of connectors (71) by the pressure medium perpendicular to the coupling direction, being larger than 1.

12. A quick coupling in accordance with claim 10, wherein the piston (60) can be put into flow connection with a plurality of pressure medium lines (67,68,69, 70) of a pressure medium circuit to be coupled, with a valve arrangement (72, 73, 74) being provided between the pressure medium lines and (67,68,69,70) and the piston (60) which connects the piston (60) to the pressure medium line standing under highest pressure.

13. A quick coupling in accordance with claim 11, wherein the piston (60) is fed from the pressure medium circuit on the tool side.

14. A quick coupling in accordance with claim 10, wherein said piston (60) is fed by a pressure medium separate from a pressure medium circuit to be coupled.

15. A quick coupling in accordance with claim 8, wherein the power circuit coupling can be travelled together with a time delay relative to the pivoting together movement of the quick coupling by the pressure ram (32).

16. A quick coupling in accordance with claim 8, wherein the pressure ram (32) is provided on an end face with a pressure cap (75), with a tiltable connection being provided between the pressure ram (32) and the pressure cap (74).

17. A quick coupling in accordance with claim 1, wherein at least one of the two power coupling parts (15) can be at least one of tilted about an axis parallel to the first latching axle (7) and movably mounted in a direction substantially perpendicular to the first latching axle (7).

18. A quick coupling in accordance with claim 1, wherein a pre-centering means (29) is provided for pre-centering the two power coupling parts (14, 15) on the pivoting together of the quick coupling parts (2, 5).

19. A quick coupling in accordance with claim 1, wherein a pivot guide (44) is provided for the two quick coupling parts (2, 5) which forces the two quick coupling parts (2, 5) towards one another on pivoting together into alignment or prevents pivoting together with misalignment of the two quick coupling parts (2,5).

20. An apparatus in accordance with claim 19, wherein the pivot guide (44) has guide surfaces (46, 47) spaced from the first latching axle (7), which are provided at the quick coupling part (2) at the boom side or at the quick coupling part (5) at the tool side and slide off on or past one another on the pivoting together of the two quick coupling parts (2,5) about the first latching axle (7).

21. A quick coupling in accordance with claim 1, wherein the power circuit coupling (13) is an assembly unit which can be subsequently mounted on the two quick coupling parts (2, 5).

22. A quick coupling in accordance with claim 1, wherein the power circuit coupling (13) is arranged outside the two latching axles (7, 8).

23. A quick coupling in accordance with claim 1, wherein the two quick coupling parts (2, 5) each have two spaced carrier members (16, 17) substantially perpendicular to the latching axles (7, 8) and the power coupling parts (14, 15) are each arranged between two associated carrier members (16, 17) transversely thereto.

24. A quick coupling in accordance with claim 1, wherein the power coupling parts (14, 15) each have substantially plate-shaped carrier members (19, 20) and male or female connector members (18) arranged perpendicular to the plate-shaped carrier members (19, 20).

25. A quick coupling in accordance with claim 1, wherein the power coupling parts (14, 15) are each designed as a connector block which has a plurality of connector members (18) for a plurality of power lines.

26. A quick coupling in accordance with claim 1, wherein a bar (49) is provided for form-locking latching of the two power coupling parts (14,15) in coupled position.

27. A quick coupling in accordance with claim 1, wherein the boom (3) forms part of an hydraulic excavator and said power circuit coupling is an hydraulic coupling.

28. A quick coupling in accordance with claim 2, wherein said guide elements (24, 25) enter into engagement before the two power coupling parts (14, 15) enter into engagement with one another.

29. A quick coupling in accordance with claim 3, wherein said guide bolt (24) has a rounded head (26), a cylindrical guide section (27) and a constriction (28) between the head (26) and guide section (27).

30. A quick coupling in accordance with claim 4, wherein said transverse bolt (48) is hydraulically actuatable.

31. A quick coupling in accordance with claim 7, wherein said spring device (21) comprises an arrangement of a plurality of compression springs (22).

32. A quick coupling in accordance with claim 12, wherein said piston (60) is in flow connection with all said pressure medium lines (67, 68, 69, 70).

33. A quick coupling in accordance with claim 16, wherein said tiltable connection comprises surfaces rounded in complementary fashion with respect to one another.

34. A quick coupling in accordance with claim 18, wherein said pre-centering means (29) comprise a pair of centering surfaces (30, 31) which slide off one another on pivoting together and of which one is arranged at the movably mounted power coupling part (15) and the other at the other power coupling part (14) or quick coupling part (2).

35. A quick coupling in accordance with claim 24, additionally comprising guide bolts (24) and guide bores (25) being rigidly connected to said carrier members (19, 20) or formed in the same for linear guiding the two power coupling parts (14, 15).

36. A quick coupling in accordance with claim 26, wherein said bar (49) is biased in latching position by at least one of a spring and hydraulic actuation.

* * * * *